US006857464B2

(12) United States Patent
LeBlanc et al.

(10) Patent No.: US 6,857,464 B2
(45) Date of Patent: Feb. 22, 2005

(54) ADJUSTABLE CASTING MOLD

(75) Inventors: Guy LeBlanc, Longueuil (CA); Julien Lemieux, Sorel-Tracy (CA); James P. Anson, Saint-Laurent (CA); Donald A. Wilson, Oakville (CA)

(73) Assignee: Hatch Associates Ltd., Ontario (CA)

( * ) Notice: Subject to any disclaimer, the term of this patent is extended or adjusted under 35 U.S.C. 154(b) by 0 days.

(21) Appl. No.: 10/246,765

(22) Filed: Sep. 19, 2002

(65) Prior Publication Data

US 2004/0055732 A1 Mar. 25, 2004

(51) Int. Cl.[7] ..... B22D 11/24
(52) U.S. Cl. ..... 164/444; 164/436; 164/487
(58) Field of Search ..... 164/418, 444, 164/435, 436, 487

(56) References Cited

U.S. PATENT DOCUMENTS

| | | | |
|---|---|---|---|
| 1,671,088 | A | 5/1928 | Dahl |
| 2,007,301 | A | 7/1935 | Lemieux |
| 2,233,106 | A | 2/1941 | McGuire |
| 2,276,657 | A | 3/1942 | Junghans |
| 2,849,767 | A | 9/1958 | Sitton |
| 2,895,189 | A | 7/1959 | Maertens |
| 3,049,769 | A | 8/1962 | Schultz |
| 3,082,496 | A | 3/1963 | Bungeroth et al. |
| 3,226,782 | A | 1/1966 | Schultz |
| 3,292,216 | A | 12/1966 | Colombo |
| 3,375,865 | A | 4/1968 | Boichenko et al. |
| 3,439,736 | A | 4/1969 | Strohschien et al. |
| 3,528,483 | A | 9/1970 | Mallener |
| 3,528,485 | A | 9/1970 | Vogel |
| 3,528,487 | A | 9/1970 | Wognum et al. |
| 3,559,720 | A | 2/1971 | Vogel et al. |
| 3,583,473 | A | 6/1971 | Strohschein et al. |
| 3,612,150 | A | 10/1971 | Rossi |

(List continued on next page.)

FOREIGN PATENT DOCUMENTS

| | | |
|---|---|---|
| DE | 10 59 626 | 6/1959 |

OTHER PUBLICATIONS

Kunitoshi Takahi et al., "Development of Adjustable Mold Technology", Light Metals 1993: Proceedings of the Technical Sessions Presented by the TMS Light Metals Committee at the 122$^{nd}$ TMS Annual Meeting, Denver, Colorado, Feb. 21–25, 1993. pp. 701–707.

Patent Abstracts of Japan, vol. 012, No. 109 (M–682), Apr. 8, 1988 & JP 62 240145 A (Kawasaki Steel Corp), Oct. 20, 1987 abstract.

Patent Abstracts of Japan, vol. 2002, No. 09, Sep. 4, 2002 & JP 2002 137045 A (Nippon Light Metal Co Ltd), May 14, 2002 abstract.

Annex to Form PCT/ISA/206 Communication Relating to the Results of the Partial International Search, mailed Mar. 4, 2004.

*Primary Examiner*—Kiley Stoner
*Assistant Examiner*—Len Tran
(74) *Attorney, Agent, or Firm*—Shlesinger Arkwright & Garvey LLP

(57) ABSTRACT

An adjustable mold for direct chill casting of metals has longitudinally movable end walls which are clamped between the mold side walls during casting. Each end wall is secured to a sliding carriage which supports the end wall and allows it to be moved along the end portions of the side walls. The sliding suspender has a clamping mechanism which applies a clamping force to one or both of the side walls, the force being transversely directed through a center of the end wall. The side walls are pivotable relative to one another to allow clamping and unclamping of the end walls. Preferably, one end of each side wall is pivotable so as to transversely displace the opposite end of the side wall, with the pivoting ends of the respective side walls preferably being opposite one another across the mold.

48 Claims, 13 Drawing Sheets

U.S. PATENT DOCUMENTS

| | | | |
|---|---|---|---|
| 3,627,027 | A | 12/1971 | Adamec et al. |
| 3,662,814 | A | 5/1972 | Kipp et al. |
| 3,672,436 | A | 6/1972 | Wognum et al. |
| 3,701,380 | A | 10/1972 | Richter et al. |
| 3,710,843 | A | 1/1973 | Murakami et al. |
| 3,710,845 | A | 1/1973 | Burkhardt et al. |
| 3,712,367 | A | 1/1973 | Plichta |
| 3,717,197 | A | 2/1973 | Strack et al. |
| 3,735,801 | A | 5/1973 | Burkhardt |
| 3,736,977 | A | 6/1973 | Stockinger |
| 3,760,867 | A | 9/1973 | Murakami et al. |
| 3,794,105 | A | 2/1974 | Voss et al. |
| 3,838,730 | A | 10/1974 | Nagoaka et al. |
| 3,913,658 | A | 10/1975 | Schmid |
| 3,926,244 | A | 12/1975 | Meier et al. |
| 3,933,192 | A | 1/1976 | Rodenchuk et al. |
| 3,957,105 | A | 5/1976 | Foye |
| 3,964,727 | A | 6/1976 | Gladwin |
| 3,978,909 | A | 9/1976 | Schöffmann |
| 4,006,633 | A | 2/1977 | Shipman et al. |
| 4,010,793 | A | 3/1977 | Takemura et al. |
| 4,022,265 | A | 5/1977 | Takahasi et al. |
| 4,036,284 | A | 7/1977 | Hoffmann |
| 4,061,177 | A | 12/1977 | Sivilotti |
| 4,069,863 | A | 1/1978 | Hargassner et al. |
| 4,085,793 | A | 4/1978 | Scheinecker et al. |
| 4,086,951 | A | 5/1978 | Takahasi et al. |
| 4,105,059 | A | 8/1978 | Ohnishi et al. |
| 4,124,058 | A | 11/1978 | Gladwin |
| 4,124,059 | A | 11/1978 | Roggo |
| 4,134,441 | A | 1/1979 | Ohmori et al. |
| 4,147,202 | A | 4/1979 | Gay |
| 4,171,719 | A | 10/1979 | Wünnenberg et al. |
| 4,173,251 | A | 11/1979 | Scheinecker |
| 4,245,692 | A | 1/1981 | Hargassner et al. |
| 4,270,593 | A | 6/1981 | Bachner |
| 4,299,266 | A | 11/1981 | Hashio et al. |
| 4,300,618 | A | 11/1981 | Properzi |
| 4,304,290 | A | 12/1981 | Wolf |
| 4,313,487 | A | 2/1982 | Hashio et al. |
| 4,356,860 | A | 11/1982 | Gladwin |
| 4,356,862 | A | 11/1982 | Gloor |
| 4,413,667 | A | 11/1983 | Schrewe et al. |
| 4,421,155 | A | 12/1983 | Wagstaff |
| 4,441,543 | A | 4/1984 | Muranaka et al. |
| 4,450,887 | A | 5/1984 | Wilkins |
| 4,465,122 | A | 8/1984 | Ohya |
| 4,480,976 | A | 11/1984 | Vaubel et al. |
| 4,487,249 | A | 12/1984 | Wrhen |
| 4,503,901 | A | 3/1985 | Vinogradov et al. |
| 4,505,321 | A | 3/1985 | Zeller |
| 4,506,724 | A | 3/1985 | Vial |
| 4,510,990 | A | 4/1985 | Artz et al. |
| 4,512,386 | A | 4/1985 | Haller |
| 4,516,622 | A | 5/1985 | Thöne et al. |
| 4,516,624 | A | 5/1985 | Poran et al. |
| 4,522,251 | A | 6/1985 | Koshikawa et al. |
| 4,523,623 | A | 6/1985 | Holleis et al. |
| 4,545,424 | A | 10/1985 | Sato |
| 4,546,813 | A | 10/1985 | Grove et al. |
| 4,553,604 | A | 11/1985 | Yaji et al. |
| 4,557,315 | A | 12/1985 | Vaubel et al. |
| 4,562,876 | A | 1/1986 | Hargassner et al. |
| 4,566,523 | A | 1/1986 | Vaubel |
| 4,572,277 | A | 2/1986 | Fleming et al. |
| 4,625,788 | A | 12/1986 | Buxmann et al. |
| 4,635,702 | A | 1/1987 | Kolakowski et al. |
| 4,635,704 | A | 1/1987 | Chielens et al. |
| 4,637,452 | A | 1/1987 | Kawakami |
| 4,651,802 | A | 3/1987 | Wrhen |
| 4,660,615 | A | 4/1987 | Lemper |
| 4,660,617 | A | 4/1987 | Tsutsumi et al. |
| 4,669,526 | A | 6/1987 | Hury |
| 4,679,614 | A | 7/1987 | Grove |
| 4,699,201 | A | 10/1987 | Gladwin |
| 4,702,303 | A | 10/1987 | Monheim et al. |
| 4,706,733 | A | 11/1987 | Pietryka et al. |
| 4,719,966 | A | 1/1988 | Röhrig |
| 4,727,925 | A | 3/1988 | Asari et al. |
| 4,727,926 | A | 3/1988 | Tsutsumi et al. |
| 4,770,228 | A | 9/1988 | Artz et al. |
| 4,774,996 | A | 10/1988 | Ahrens et al. |
| 4,789,021 | A | 12/1988 | Ahrens |
| 4,854,371 | A | 8/1989 | Katahira et al. |
| 4,869,310 | A | 9/1989 | Yanagi et al. |
| 4,881,589 | A | 11/1989 | Hartmann et al. |
| 4,883,111 | A | 11/1989 | Lax et al. |
| 4,892,134 | A | 1/1990 | Zuber |
| 4,942,919 | A | 7/1990 | Poran et al. |
| 4,960,165 | A | 10/1990 | Eidinger et al. |
| 5,033,536 | A | 7/1991 | Keutgen et al. |
| 5,036,902 | A | 8/1991 | Streubel et al. |
| 5,085,263 | A | 2/1992 | Deussen et al. |
| 5,146,975 | A | 9/1992 | Negishi |
| 5,205,345 | A | 4/1993 | McClellan et al. |
| 5,207,269 | A | 5/1993 | Heestand et al. |
| 5,242,010 | A | 9/1993 | Pleschiutschnigg et al. |
| 5,249,622 | A | 10/1993 | Dalimonte |
| 5,273,100 | A | 12/1993 | Arici |
| 5,279,354 | A | 1/1994 | Grove |
| 5,307,862 | A | 5/1994 | Sakata et al. |
| 5,322,112 | A | 6/1994 | Sakata |
| 5,333,671 | A | 8/1994 | Sera et al. |
| 5,335,716 | A | 8/1994 | Takesue et al. |
| 5,386,869 | A | 2/1995 | Wilde |
| 5,472,040 | A | 12/1995 | Brückner |
| 5,517,764 | A | 5/1996 | Lobb, Jr. |
| 5,582,229 | A | 12/1996 | Festl et al. |
| 5,730,207 | A | 3/1998 | Pleschiutschnigg |
| 5,836,375 | A | 11/1998 | Thöne et al. |
| 5,839,503 | A | 11/1998 | Pleschiutschnigg |
| 5,850,871 | A | 12/1998 | Sears, Jr. |
| 5,931,216 | A | 8/1999 | Carrupt et al. |
| 5,947,184 | A | 9/1999 | Steen et al. |
| 5,979,538 | A | 11/1999 | Braun et al. |
| 6,041,848 | A | 3/2000 | Langner |
| 6,056,040 | A | 5/2000 | Weaver et al. |
| 6,070,645 | A | 6/2000 | Pleschiutschnigg |
| 6,112,394 | A | 9/2000 | Seidel et al. |
| 6,142,212 | A | 11/2000 | Scholz et al. |
| 6,145,580 | A | 11/2000 | Lamberti et al. |
| 6,176,295 | B1 | 1/2001 | Pleschiutschnigg |
| 6,382,304 | B1 | 5/2002 | Genge |

57
57
57
50
50
52
52
48
48
148
49
49
148
P
P
55
16
54
16
56
55
54
56
102
13
16
16
12

ADJUSTABLE CASTING MOLD

FIELD OF THE INVENTION

This invention relates to molds for direct chill casting of metal ingots, and more particularly to such molds having at least one adjustable mold wall.

BACKGROUND OF THE INVENTION

Metal sheet ingots of rectangular cross-section have a number of uses in industry. Such ingots are commonly cast by a process known as "direct chill" casting. This process utilizes an open-topped mold having four fluid-cooled walls, two relatively long side walls and two relatively short end walls. The wide faces of the ingot are formed along the side walls and the short edges of the ingot are formed along the end walls.

The direct chill casting mold has a bottom block which is movable downwardly during the casting operation. Molten metal to be cast is poured into the open top of the mold, and as casting progresses the bottom block is moved downwardly away from the mold.

The molten metal is initially cooled by contact with the fluid-cooled mold walls, causing formation of a solidified outer shell. This is known as "primary cooling". As the ingot emerges from the bottom of the mold, coolant is sprayed directly onto its outer surface to further cool the ingot. This is known as "secondary cooling".

Sheet ingots are cast in many sizes, and there is a continuous demand for new ingot sizes having different cross-sectional areas. In order to avoid the need to completely replace a mold for each ingot size, and thereby minimize casting equipment inventory, molds with adjustable walls have been developed. Most commonly, such molds are adjustable in width only, with the short end walls being movable inwardly and outwardly relative to each other. Changing the ingot thickness normally requires replacement of the whole adjustable mold assembly with its corresponding bottom block.

Although numerous types of adjustable molds for direct chill casting have been developed in the past, there remains a need for an effective yet simple and reliable mold system for direct chill casting.

SUMMARY OF THE INVENTION

The present invention overcomes at least some of the problems of the prior art by providing an adjustable mold assembly which is simple, easy to operate and reliable, and which permits alteration of the mold width and thickness with a minimum number of components.

In one aspect, the present invention relates to an improved mechanism for retaining and moving the end walls longitudinally relative to the side walls and for clamping the movable end walls between the side walls. In a preferred embodiment of the invention, the end walls are secured to a sliding carriage (also referred to herein as a "sliding suspender") which is movable along the end portions of the side walls. The sliding carriage is provided with at least one clamping mechanism to apply a clamping force to one or both of the side walls, with the force being directed transversely through the end wall.

In another aspect, the present invention relates to an improved mechanism by which the side walls can be pivoted relative to one another to alternately clamp and unclamp the end walls, permitting the end walls to be moved longitudinally when the side walls are separated. In a preferred embodiment, one end of each side wall is pivotable so as to transversely displace the opposite end of the side wall, with the pivoting ends of the respective side walls preferably being opposite one another across the mold space.

In yet another aspect, the present invention provides a bottom block assembly comprising a center block and at least one removable end section. Each removable end section is secured to the center block by a clamping mechanism in which a protrusion in one of the center block and the end section is received in a cavity formed in the other of the center block and the end section. Preferably, the protrusion and the cavity engage one another in an interlocking arrangement, and the protrusion preferably comprises a screw-driven block having a retractable jaw member which engages an inner surface of the cavity, while accommodating differential expansion.

In yet another aspect, the invention provides means for preventing excessive cooling at the corners of the ingot being cast. In one preferred aspect, the movable end walls are provided with means for blocking one or more coolant openings at the mold corners, and in another preferred aspect, means is provided for blowing some of the coolant away from the surface of the ingot near its corners.

In yet another aspect, the mold is provided with an improved and optional lubrication system in which a lubricant delivery channel delivers a casting lubricant to a strip of porous material located proximate the inner surface of one or more of the mold walls. The lubricant passes through the porous strip and is evenly distributed over the surface of the ingot being cast.

According to one preferred aspect of the invention, there is provided a mold for direct chill casting of metal ingots, the mold comprising a pair of opposed side walls and a pair of opposed end walls which together define a generally rectangular mold space having an open top through which molten metal enters the mold; each of the side walls having a first end portion, an opposed second end portion, an inner surface and an opposed outer surface, and at least one of the end walls comprising a movable end wall assembly which is movable relative to the side walls to alter an area of the mold space, each the movable end wall assembly comprising: (a) a central end wall member extending across a space between the end portions of the side walls, the central end wall member having opposed end surfaces which are sealable against the inner surfaces of the side walls; (b) a pair of upper extension members attached to the central end wall member, each of the upper extension members extending outwardly beyond an end surface of the central end wall member and over one of the side walls; (c) a pair of lower extension members attached to the central end wall member, each of the lower extension members extending outwardly beyond an end surface of the central end wall and under one of the side walls; (d) a pair of connecting members, each of which extends along the outer surface of one of the side walls and connects one of the lower extension members and one of the upper extension members, wherein the extension members and the connecting members together define a pair of spaces, each located outwardly of an end surface of the central end wall member, through which the side walls extend; and (e) clamping means movable with the movable end wall assembly to clamp the side walls into sealing engagement with the end surfaces of the central end wall member.

Preferably, each of the side walls has an internal coolant passage and a plurality of coolant openings communicating with the internal coolant passage, the coolant openings being positioned proximate the inner surface of the side wall and oriented to receive coolant from the coolant passage and direct the coolant downwardly and inwardly at the ingot as it emerges from a lower end of the mold, the mold further comprising: (f) blower means for blowing a fluid toward the coolant as it exits one or more of the coolant openings in the side wall, the blower being directed to blow the coolant away from contact with corners of the ingot emerging from the lower end of the mold.

According to another preferred aspect of the present invention, there is provided a mold for direct chill casting of metal ingots, the mold comprising a pair of opposed side walls and a pair of opposed end walls which together define a generally rectangular, planar mold space having an open top through which molten metal enters the mold; each of the side walls having a first end portion, an opposed second end portion, an inner surface and an opposed outer surface, each end portion of each side wall and the end walls extending across a space between the end sections of the side walls, with each end wall having opposed end surfaces which are sealable against the inner surfaces of the side walls; each of the side walls being pivotable about a pivot axis extending through its first end portion, the pivot axis being perpendicular to a plane defined by the mold space, wherein pivoting of each side wall about the pivot axis displaces the second end portion of that side wall relative to the other side wall, thereby altering a distance across the mold space between the end sections of the opposed side walls.

According to yet another preferred aspect of the present invention, there is provided a mold for direct chill casting of metal ingots, the mold comprising a pair of opposed side walls and a pair of opposed end walls which together define a generally rectangular mold space having an open top through which molten metal enters the mold, the mold having a bottom block which is received in the mold space at the beginning of a casting operation and which is movable downwardly away from the mold during casting, the bottom block comprising: (a) a center section attached to a base plate, the center section having opposed sides which extend along the mold side walls when the bottom block is received in the mold space; and (b) a pair of end sections, each having a side which extends along one of the mold end walls when the bottom block is received in the mold space, wherein at least one of the end sections is releasably attached to the center section along a joint line which extends between the sides of the center section; each of the at least one releasable end sections being secured to the center section by a clamping mechanism comprising: (i) a cavity provided in a surface of one of the end section and the center section; (ii) a protrusion provided on a surface of the other of the end section and the center section, the protrusion being received in the cavity when the end section is attached to the center section along the joint line, and (iii) moving means for moving the protrusion relative to the cavity; wherein the cavity has an inner surface, the moving means moving the protrusion into engagement with the inner surface of the cavity to clamp the end section into engagement with the center section along the joint line.

According to yet another preferred aspect of the present invention, there is provided a mold for direct chill casting of metal ingots, the mold comprising a pair of opposed side walls and a pair of opposed end walls which together define a generally rectangular mold space having an open top through which molten metal enters the mold, wherein each side wall is provided with a lubricant delivery system for delivering a lubricating material to an inner surface of the side wall, the lubricant delivery system comprising: (a) a lubricant delivery channel extending along the side wall, the lubricant delivery channel receiving a lubricant from an external supply of lubricant; (b) a strip of porous material extending along the lubricant delivery channel in and spaced from the delivery channel; (c) one or more first lubricant passageways extending between the lubricant delivery channel and the strip of porous material; and (d) one or more second lubricant passageways extending between the strip of porous material and the inner surface of the side wall, the second lubricant passageways communicating with the mold space.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
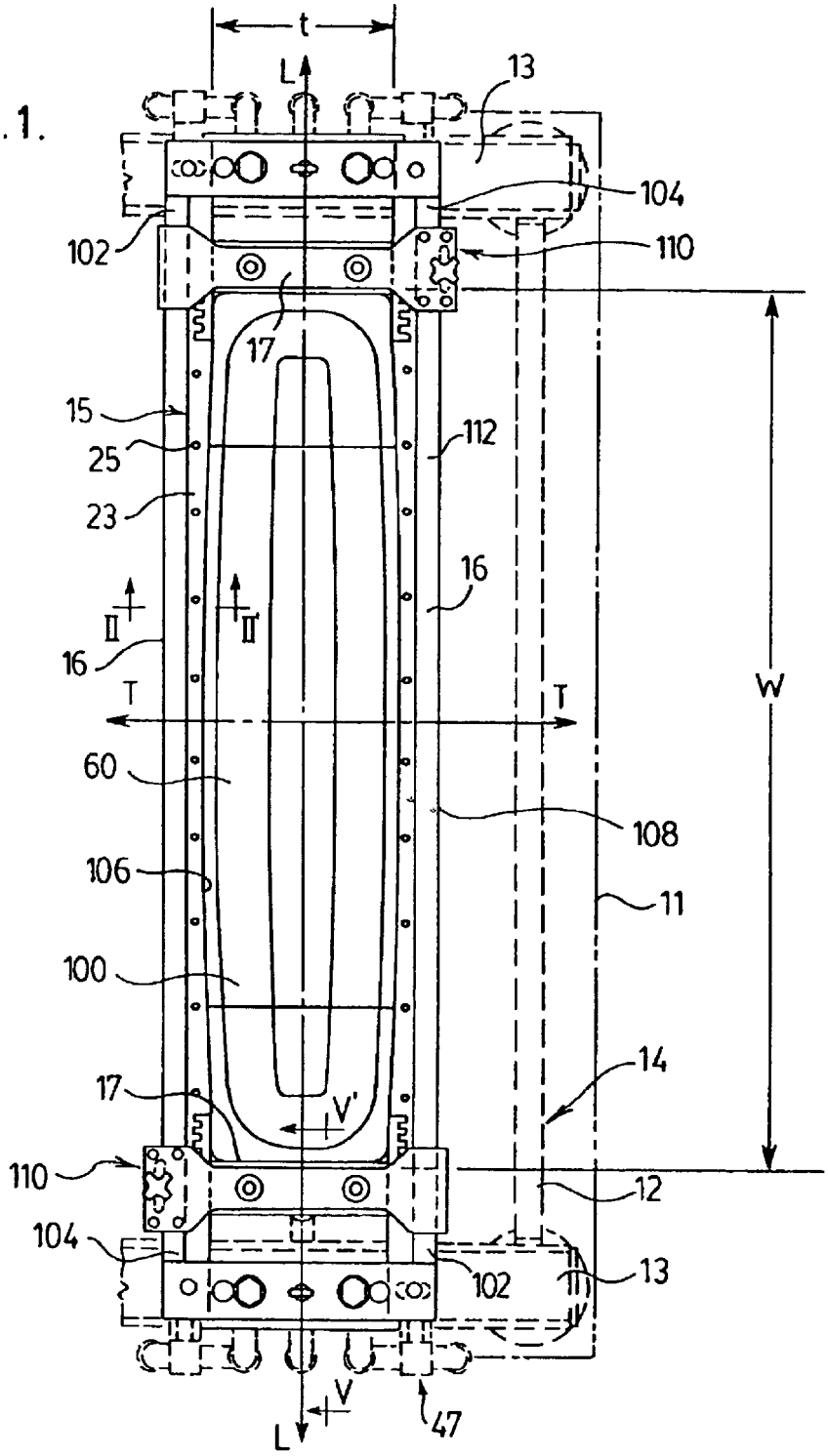
FIG. 1 is a plan view of an adjustable mold assembly according to the present invention.

FIG. 1 illustrates the main components of a preferred adjustable mold assembly 15 according to the invention. Mold assembly 15 comprises a pair of opposed side walls 16 and a pair of opposed end walls 17 which together define a generally rectangular mold space 100 having an open top through which molten metal enters the mold 15. The relatively long side walls 16 are generally parallel to each other and to a longitudinal axis L. The relatively short end walls 17 are parallel to each other and to a transverse axis T. The wide faces and short edges of the ingot (not shown) are formed along side walls 16 and along the end walls 17. The nominal width w of the ingot is defined by the longitudinal distance between the end walls 17, and the nominal thickness t of the ingot is defined by the length of the end walls 17, measured parallel to the transverse axis T.

Figure 2:
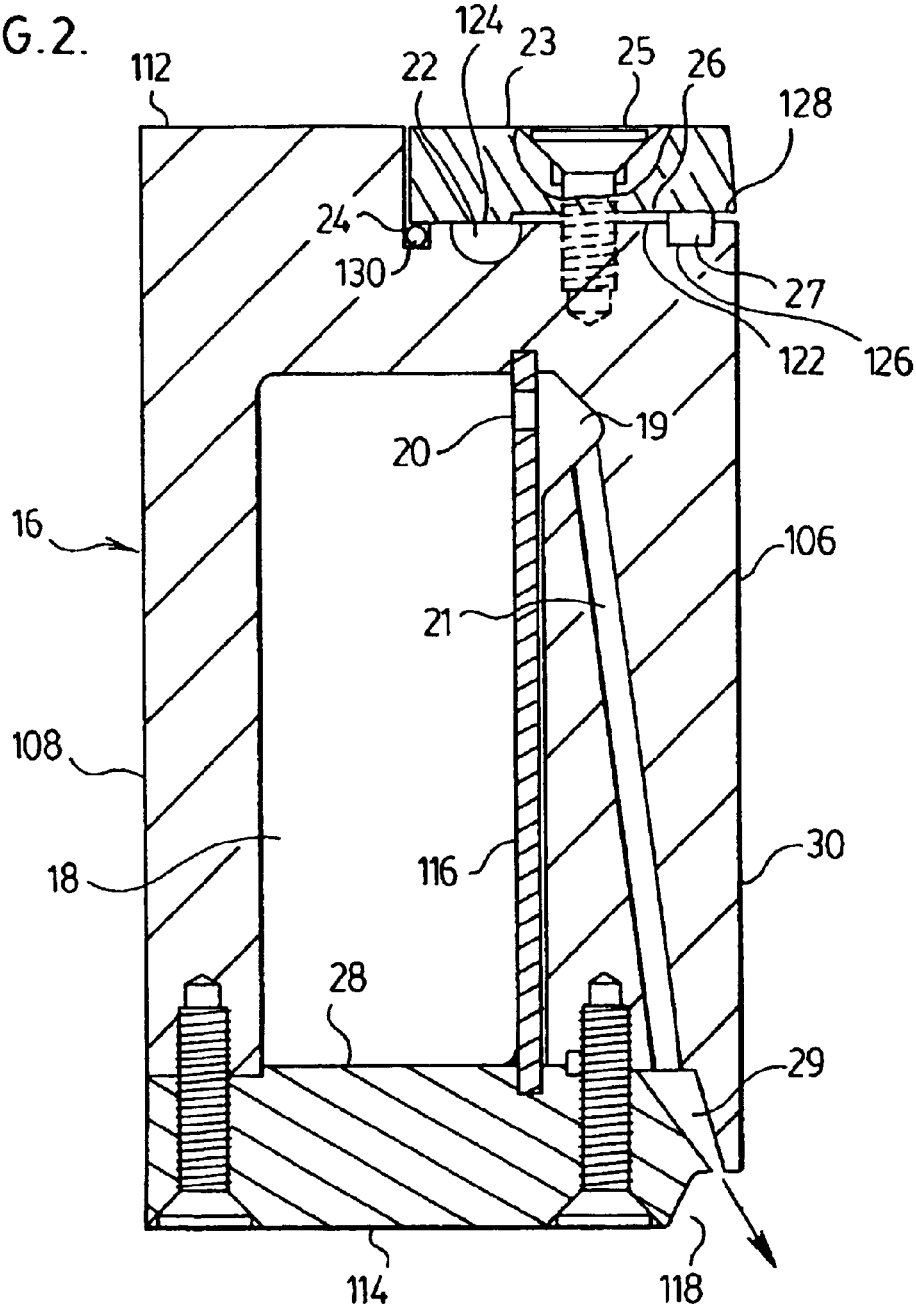
FIG. 2 is a transverse cross-section along line II—II' of FIG. 1.

Each of the side walls 16 has a first end portion 102, a second end portion 104, an inner surface 106 facing into mold space 100, an opposed outer surface 108, an upper surface 112 and a lower surface 114 (FIG. 2). As illustrated in FIG. 1, the end portions 102, 104 of each side wall 16 are straight and parallel to the longitudinal axis, whereas the central portion of each side wall has a convexly curved inner surface. The curvature of the central section compensates for uneven ingot shrinkage along these walls during solidification, and ensures that the wide faces and short edges of the ingot will be relatively flat in order to minimize scalping depth as well as to facilitate stacking. The end portions 102, 104 are kept flat in order to ensure a constant distance across the mold space 100 in these areas, for reasons which will be explained below.

At least one of the end walls 17 forms part of a movable end wall assembly 110 which is movable in the longitudinal direction relative to the side walls 16 to alter an area of the mold space 100. In the preferred embodiment of the invention shown in the drawings, both end walls 17 are movable.

Figure 3:
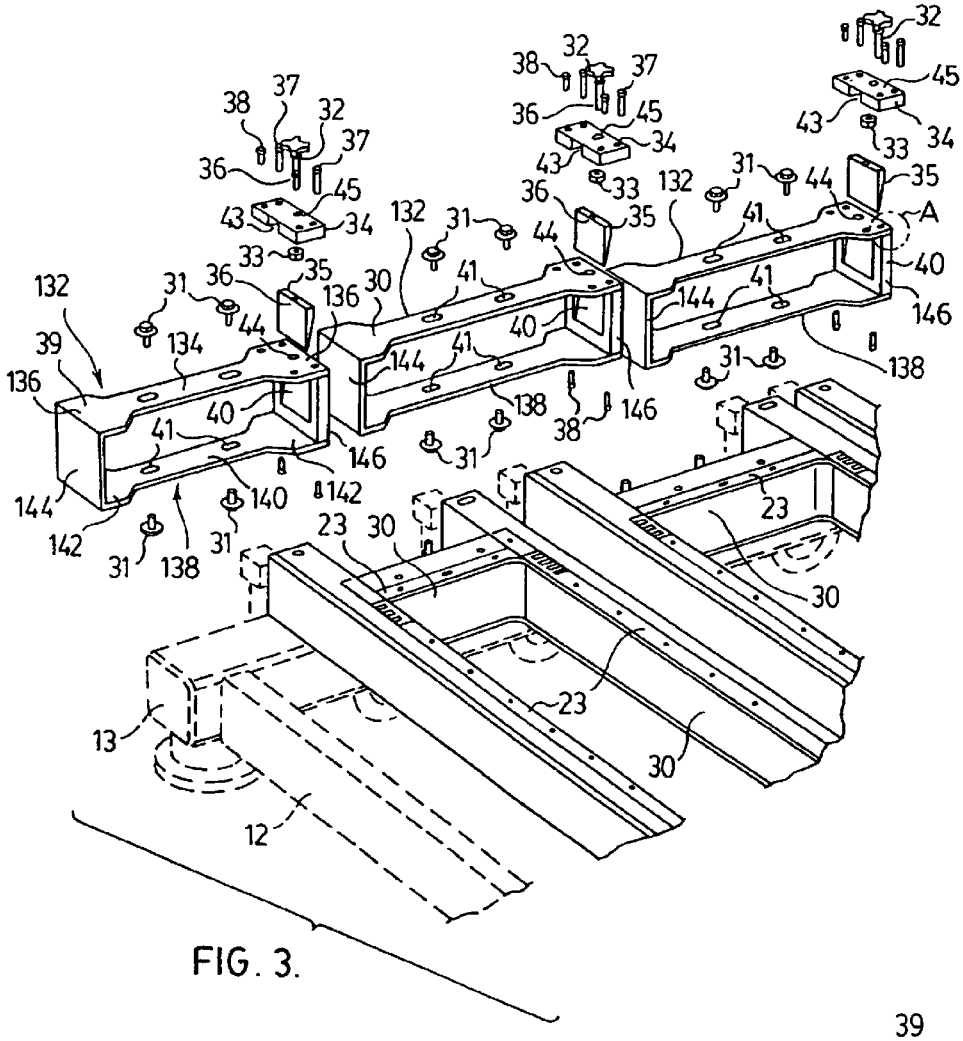
FIG. 3 is an exploded perspective view of one end of a mold assembly having three molds.
Figure 6:
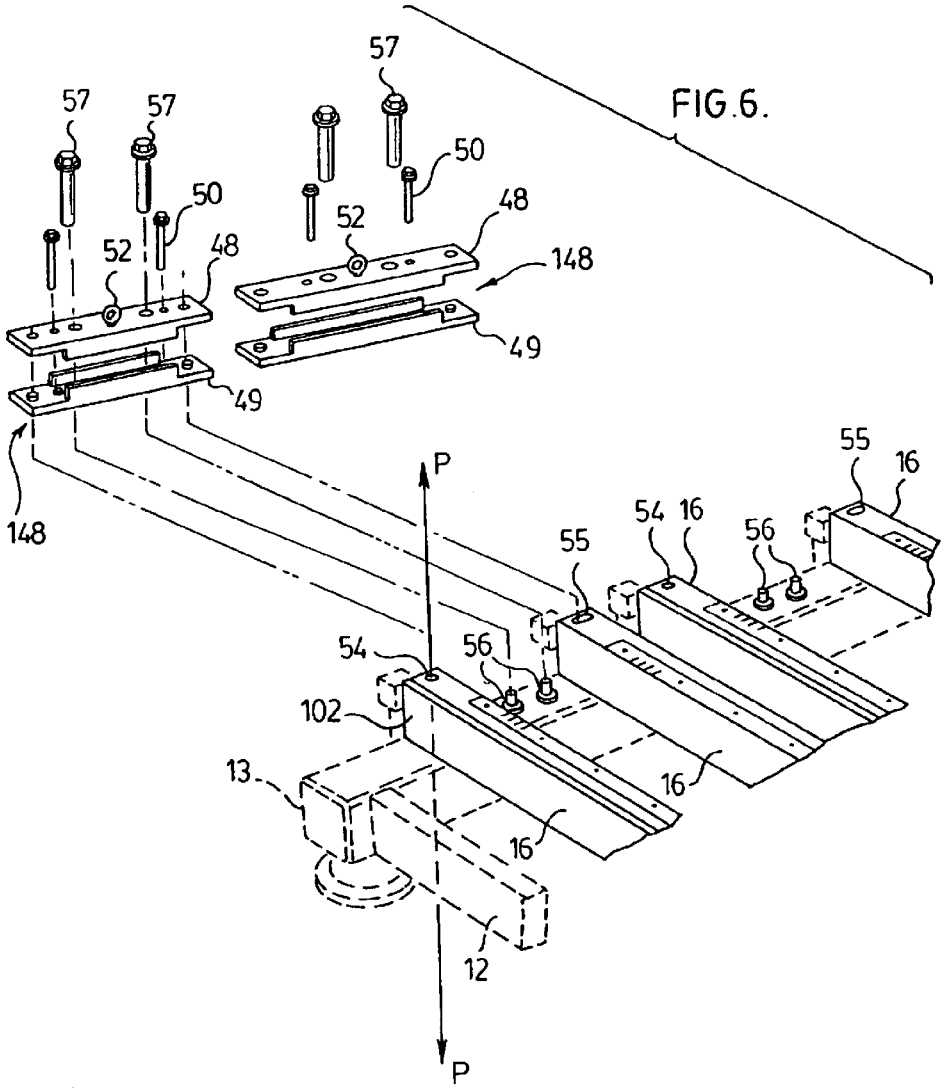
FIG. 6 is an exploded perspective view showing the ends of two adjacent mold assemblies according to the present invention.
Figure 10:
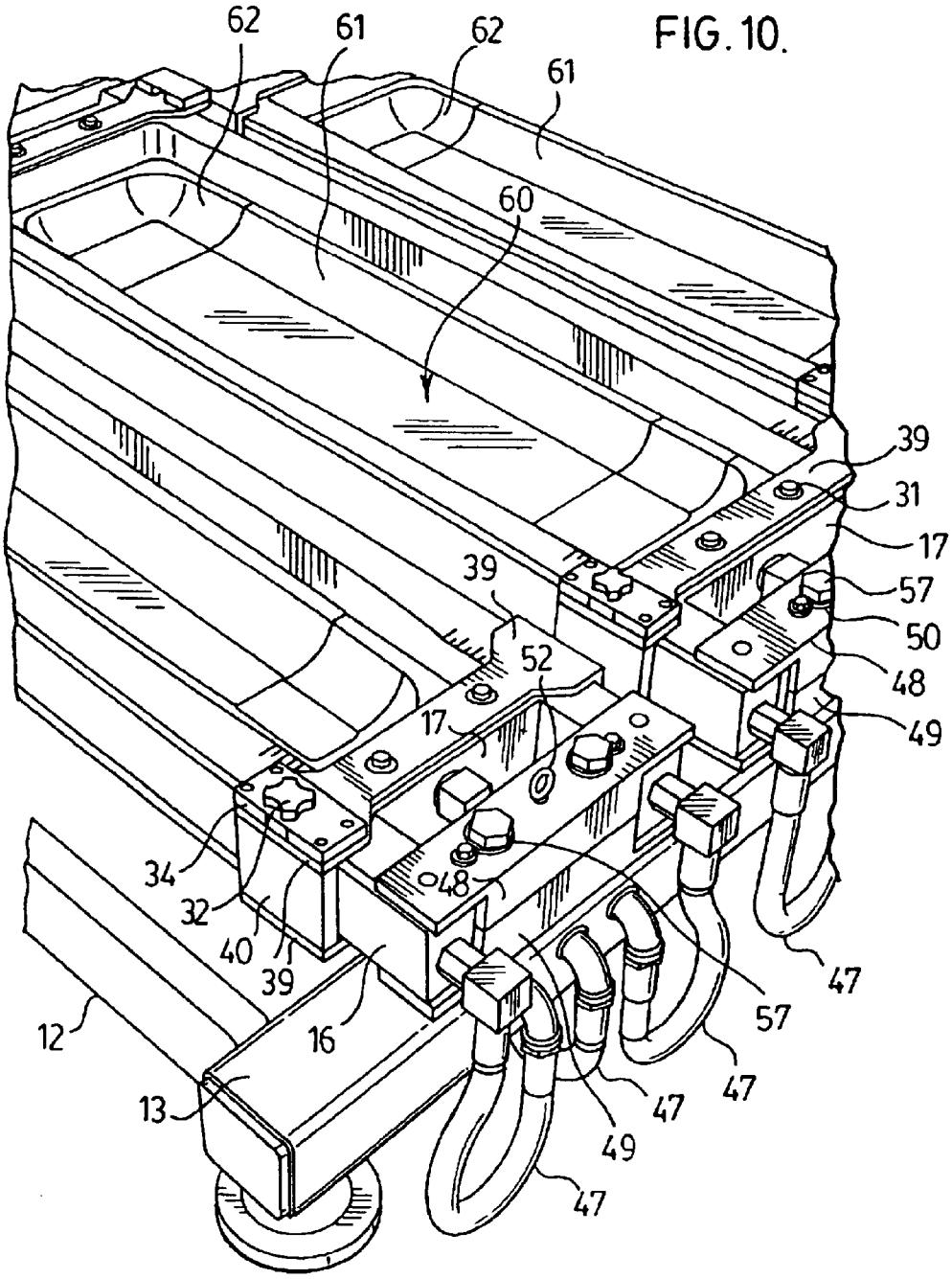
FIG. 10 is a perspective view showing portions of three adjacent mold assemblies of different cross-sectional areas according to the invention.

One or more mold assemblies 15 according to the invention may be arranged side-by-side (as shown in FIGS. 3, 6 and 10) for simultaneously casting ingots of the same or different cross-sectional area. The mold assemblies 15 are mounted with the end portions 102, 104 of side walls 16 being supported on a water header assembly 14, comprising hollow tubes 13 arranged at opposite ends of the mold 15 and being connected by a frame member or coolant tube 12. The water header assembly 14 is mounted on a casting machine carriage 11. In order to more clearly show the features of the mold assembly 15, the casting machine carriage 11 and water header assembly 14, including member 12 and tubes 13, are shown in dotted lines in FIG. 1.

Both the side walls 16 and the end walls 17 are provided with coolant passages for a liquid coolant, preferably water. The coolant is used for cooling the mold walls 16, 17 and also for secondary cooling of the ingot as it emerges from the bottom of the mold. FIG. 2 illustrates a cross-section through a mold side wall 16 illustrating its structure. End walls 17 preferably also have the structure shown in FIG. 2.

Figure 5:
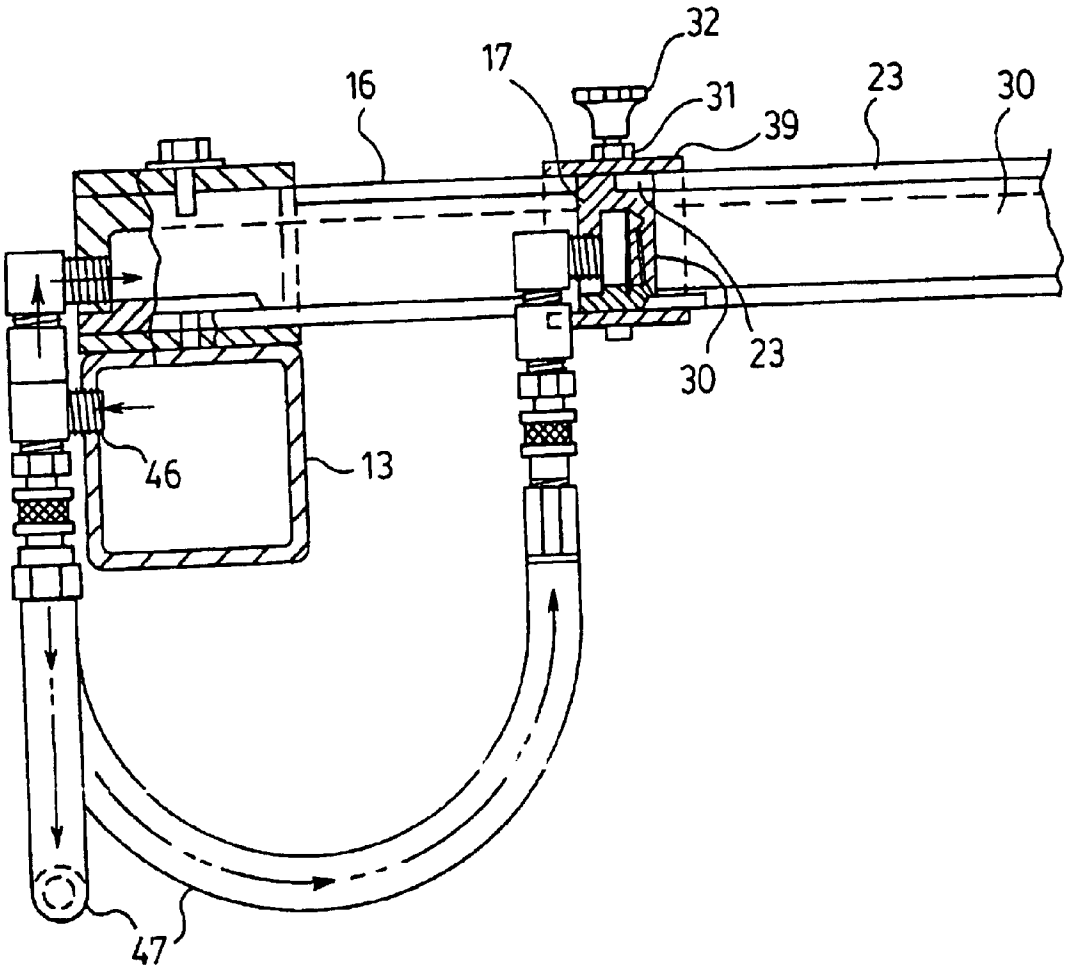
FIG. 5 is a longitudinal cross-section along line V—V' of FIG. 1.

The inner surface 106, outer surface 108 and part of the upper surface 112 of side wall 16 are defined by the mold wall body 30. The lower surface 114 of the side wall 16 is defined by a closing baffle plate 28 which is secured to the mold wall body 30 by threaded fasteners. Extending longitudinally through the side wall 16 is a primary cooling passage 18, the opposite ends of which communicate with the hollow coolant tubes 13 through flexible hoses 47 (FIGS. 1, 5 and 10). The primary cooling chamber 18 is separated from a secondary cooling chamber 19 by a vertical orifice plate 116 which is perforated by a plurality of apertures 20 providing communication between the chambers 18 and 19. Coolant from secondary chamber 19 passes through inclined coolant passageways 21 to a coolant delivery channel 29 provided between the mold wall body 30 and the closing baffle plate 28. The delivery channel 29 may preferably comprise a plurality of longitudinally spaced apertures or may comprise a continuous, longitudinally extending slot. Most preferably, the mouth of delivery channel 29 forms a slot extending longitudinally along substantially the entire length of side wall 16, such that a continuous "curtain" of coolant is delivered from channel 29 to the outer surface of the ingot as it emerges from the bottom of mold 15, thereby providing secondary cooling of the ingot. The lower inside part 118 of baffle plate 28 is preferably recessed to provide clearance between the mouth of coolant delivery chamber 29 and the ingot as it emerges from the bottom of the mold.

It is also preferred to provide a lubricant between the metal being cast and the inner surface 106 of each side wall 16. For this purpose, each of the side walls 16 is preferably provided with a lubricant delivery system 120, which is also illustrated in FIG. 2. The lubricant delivery system 120 comprises a lubricant delivery channel 22 extending longitudinally along the length of side wall 16. The lubricant delivery channel 22 is preferably formed between an upper, recessed surface 122 of mold body 30 and a lower surface 124 of a cover plate 23 which is secured to the mold wall body 30 by self-sealing fasteners 25. As shown in FIG. 2, the surface 122 of mold body 30 is recessed relative to upper surface 112 by an amount such that the upper surface of cover plate 23 is flush with the upper surface 112 of the side wall 16. One or both ends of the lubricant delivery channel 22 receive a lubricant from an external supply of lubricant (not shown).

The lubricant delivery system 120 further comprises a strip 27 of porous material which is spaced from, and extends along, the lubricant delivery channel 22, and is preferably received in a groove 126 formed in the upper, recessed surface 122 of mold body 30.

Lubricant from delivery channel 22 flows to the strip 27 of porous material 27 through one or more first lubricant passageways 26, preferably formed as a plurality of grooves in the lower surface 124 of cover plate 23. The lubricant passes through the strip 27 of porous material, and then through one or more second lubricant passageways 128 extending between the strip 27 and the inner surface 106 of the side wall 16. The second lubricant passageways 128 open into the mold space 100 such that, during casting, the lubricant exiting passageways 128 is applied to the inner surface 106 of side wall 16 to reach the meniscus of the molten metal by gravity during casting. The second lubricant passageways 128 are formed between the lower surface 124 of cover plate 23 and the upper, recessed surface 122 of the mold wall body 30, preferably comprising a continuous, longitudinally extending passage way formed as a recess in the lower surface 124 of cover plate 23.

The cover plate 23 is preferably sealed with an O-ring 24 which is received in a groove 130 formed in the upper, recessed surface 122 of mold wall body 30, the groove being formed at the outer edge of the upper, recessed surface 122.

The casting lubricant which is fed to the surface of the ingot through the lubricant delivery system may preferably comprise any conventional direct chill casting lubricant, including natural or synthetic lubricating oils. Natural lubricating oils include vegetable oils such as canola oil and caster oil. Preferred synthetic lubricating oils may preferably include those disclosed in Canadian Patent No. 2,237,950, namely Mobil Arctic 220, Mobil Arctic 230 and Magnus CAL 192. The strip 27 may preferably be continuous or segmented, and preferably comprises graphite or another porous material, with the permeability of the strip being sufficient to assure a uniform lubricant distribution along the entire length of the mold walls 16, 17. Another advantage of the lubrication system according to the invention is that the use of a porous strip 27 such as graphite allows the lubrication system to resist leakage when the mold assembly is tilted up to retrieve the ingot from below the mold assembly.

Figure 4:
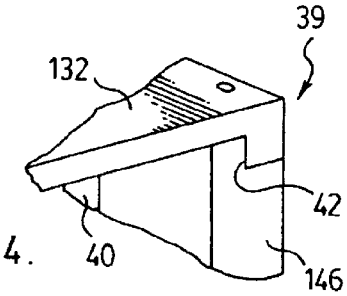
FIG. 4 is a close up of area A shown in FIG. 3.

Now having described the general structure of the mold walls 16, 17 and the wall assembly 15, a preferred movable end wall assembly 110 according to the invention is now described below with reference to the drawings, and particularly with reference to FIGS. 3, 4 and 5.

As mentioned above, both of the end walls 17 in the preferred embodiment are movable, and each form part of a movable end wall assembly 110. Each of the end walls 17 extends transversely across the space between the end portions 102, 104 of the side walls 16. Each end wall 17 has opposed end surfaces 131 (visible in FIG. 15) which are sealable against the inner surfaces 106 of the opposed side walls 16. It will be appreciated that the end surfaces of end walls 17 are sealed to the end portions 102, 104 of the side walls 16 during casting of an ingot.

Each movable end wall assembly 110 further comprises a transversely extending member 132 having a central portion 134 and opposed end portions 136 which extend transversely outwardly beyond the end surfaces 131 of the end wall 17 and over the side walls 16. Similarly, a lower transverse member 138 is provided which has a central portion 140 and a pair of end portions which extend outwardly beyond the end surfaces of the end wall 17 and under the side walls 16.

The upper and lower transverse members 132 and 138 are shown in the drawings as comprising flat plates which are secured to the upper and lower surfaces of end wall 17 by shoulder bolts 31. However, it will be appreciated that the end wall 17 may instead be provided with integral upper and lower extension members which, like end portions 136 and 142, extend beyond the end surfaces 131 of the end wall 17.

Each movable end wall assembly 110 further comprises a pair of connecting members 144 and 146, each of which extends along the outer surface 108 of a side wall 16 and connects the lower transverse member 138 and the upper transverse member 132. It will be seen from FIG. 3 that the upper and lower transverse members 132, 138 and the connecting members 144, 146 form a rectangular shaped sliding carriage 39, also referred to herein as a "sliding suspender", which is secured to the upper and lower surfaces of end wall 17. Between the end surfaces of end wall 17 and the connecting members 144 and 146, a pair of spaces are formed in which the side walls 16 are slidably received. Thus, the sliding suspender 39 is used for sliding the end walls 17 back and forth along the end portions 102, 104 of the side walls 16.

The movable end wall assembly 110 is also provided with a clamping mechanism which is movable with the end wall assembly 110 to clamp the side walls 16 into sealing engagement with the end surfaces 131 of the end walls 17. It will be appreciated that a number of different types of clamping mechanisms are possible, with but one preferred mechanism being illustrated in the drawings.

Preferably, the clamping mechanism is provided on at least one of the connecting members 144, 146 so as to force one or both of the side walls 16 into sealing engagement with the end surfaces 131 of the end walls 17. In the preferred embodiment of the invention, the clamping mechanism comprises a wedge clamp installed at one end of the sliding suspender 39. The wedge clamp comprises a vertically driven wedge 35 which is slidable in a groove 40 formed in connecting member 146. As shown in FIG. 3, the wedge 35 has a relatively thick upper end and relatively thin lower end, and the groove 40 similarly decreases in depth from its upper end to its lower end. The wedge 35 is driven by a self-locking threaded fastener 32 having a handle at its upper end for manual operation. The shank of the fastener 32 extends through a transverse slot 45 formed in a bearing plate 34 which is secured to the sliding suspender 39 by bolts 37, 38; through a thrust nut 33 which is retained captive inside a groove 43 in the lower surface of bearing plate 34; through a transverse slot 44 formed in the upper transverse member 132 of sliding suspender 39; and into an aperture in the upper surface of wedge 35, to which it is secured by a pin 36. The fastener is secured to wedge 35 such that it is free to rotate relative to the wedge 35. Clamping pressure is applied by turning the handle on fastener 32, thereby advancing the shank of fastener 32 downwardly through the thrust nut 33. This also drives the wedge 35 downwardly, progressively increasing the clamping force applied to the end walls 17. During clamping, the wedge moves inwardly against outer surface 108 of side wall 16, causing transverse displacement of thrust nut 33 in groove 43 and transverse displacement of the threaded shank of fastener 32 in slots 44 and 45.

During clamping of the end walls 17, the wedge exerts an inwardly directed clamping force on one of the side walls 16, and also exerts an outer force on the connecting member 146. Accordingly, connecting member 146 acts as a thrust plate and is therefore constructed so as to resist deformation when acted on by the clamping forces. In the preferred embodiment of the invention, the connecting member 146 is preferably constructed of a thicker material than connecting member 144. In addition, as shown in FIG. 4, the connecting member 146 is connected to the upper and lower transverse members 132, 138 in an interlocking arrangement. In the arrangement shown in FIG. 4, a shoulder 42 is machined in the top and bottom of connecting member 146. The shoulder interlocks with a corresponding ridge formed at the ends of the transverse members 132, 138. The connecting member 146 is attached to the upper transverse member 132 by threaded fasteners 37 which also secure the bearing plate 34, and is secured to the lower transverse member 138 by fasteners 38.

As shown in FIG. 3, the sliding suspenders 39 can be made in varying lengths for use in casting ingots of varying thicknesses.

It will be apparent from the above description that curvature in the end portions 102, 104 of the side walls is preferably avoided, since this could prevent smooth movement of the end walls 17 along side walls 16 and may prevent adequate sealing of the end walls 17 to the side walls 16. Therefore, the end portions 102, 104 of opposite side walls are straight and parallel to the longitudinal axis.

FIG. 5 is a longitudinal cross-sectional view showing how coolant is supplied from hollow coolant tube 13 through flexible hoses 47 to the side wall 16 and the end wall 17, the coolant flowing from tube 13 to a hose 47 through a top coolant outlet 46.

In accordance with another preferred aspect of the invention, means are provided for retaining and positioning the side walls 16 on top of the coolant tube 13, and for permitting limited transverse movement of the side walls 16 to alternately clamp and release the end walls 17, thereby allowing them to be slid along the end portions 102, 104 of the side walls 16.

According to a preferred embodiment of the invention, shown in FIGS. 6 to 9, each of the side walls 16 is able to pivot about a pivot axis P extending through the first end portion of each side wall. As shown in FIG. 6, pivot axis P is perpendicular to a plane defined by the mold assembly 15 and the mold space 100. Pivoting of each side wall 16 about the pivot axis P displaces the second end portion 104 of the side wall 16 transversely relative to the opposite side wall 16, thereby altering the distance across the mold space 100 between the end sections 102, 104 of opposed side walls 16. This can best be explained by reference to FIG. 9. With the clamping force of the wedge 35 released, side wall 16 (the left side wall in FIG. 9) is free to pivot about the pivot axis P extending through its first end portion 102. Pivoting of the side wall 16 results in transverse displacement of the second end portion 104, with the displaced position of side wall 16 being illustrated in dotted lines. Similarly, the side wall 16' (on the right side of FIG. 9) rotates about a pivot axis P extending through its first end portion 102, resulting in transverse displacement of the second end portion 104. The outwardly displaced position of side wall 16' is shown in dotted lines in FIG. 9. With the side walls 16 and 16' in their outwardly displaced positions, the end wall assemblies 110 are free to slide longitudinally along the end portions 102, 104 of the side walls, with various positions of sliding suspenders 39 being illustrated in FIG. 9.

Figure 9:
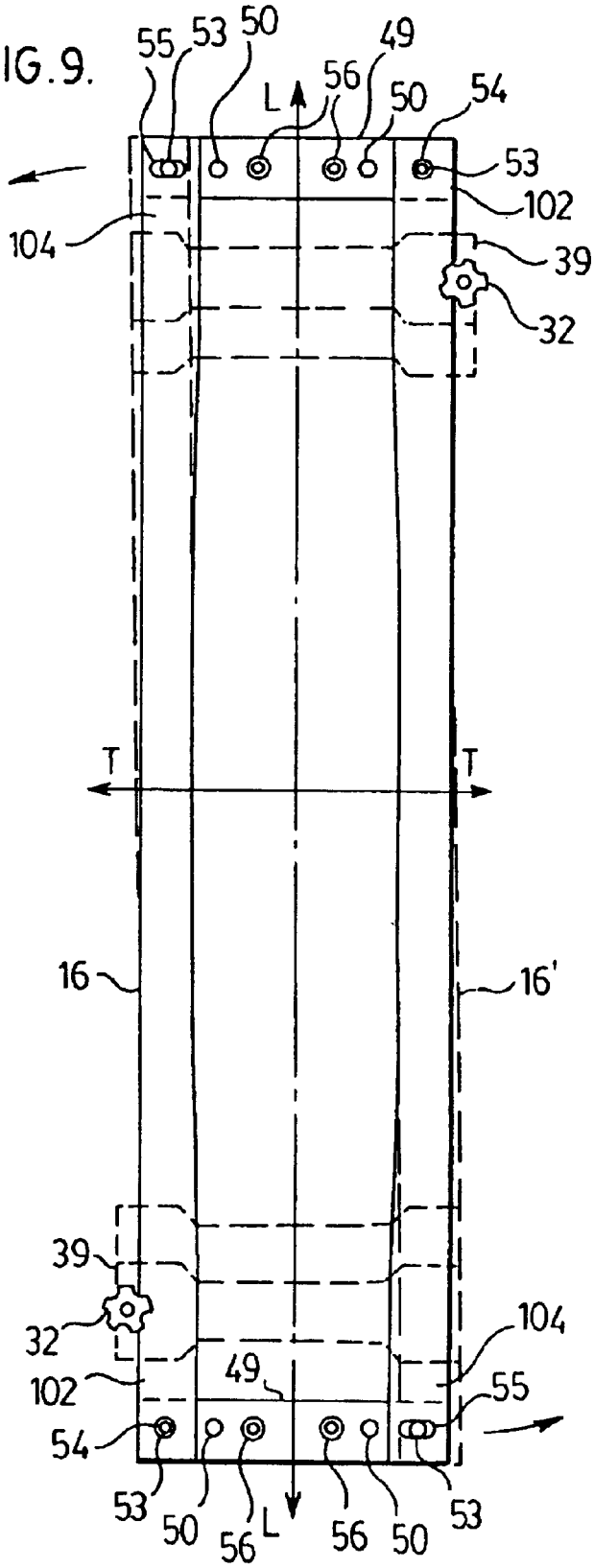
FIG. 9 is a schematic plan view of a mold assembly according to the invention illustrating the pivoting of the side walls.

As shown in FIG. 9, the first end portion 102 of side wall 16 is directly across the mold space from the second end portion 104 of the opposite side wall 16'. Placing the pivoting ends of the respective side walls at opposite ends of the mold 15 ensures that the side walls 16 remain parallel, thereby ensuring that the end walls slide easily along the side walls 16.

The pivoting of the side walls 16 is facilitated by hold down mechanisms 148 by which the side walls are secured to one or more stationary surfaces. In the preferred embodiment, the end portions 102, 104 of each side wall are attached to hollow coolant tubes 13 extending transversely at opposite ends of the mold 15.

Each hold down mechanism 148 comprises an upper member 48 and a lower member 49 between which end portions 102, 104 of the side walls 16 are received. As shown in the drawings, one hold down mechanism 148 is provided at each end of the mold 15, with each hold down mechanism 148 retaining the first end portion 102 of one side wall 16 and the second end portion 104 of the other side wall 16.

The pivoting of the side walls 16 can be accomplished in a number of ways. In the preferred embodiment shown in the drawings, the first end portion 102 of each side wall 16 pivots about a pivot member 53 which is coincident with the pivot axis P. The pivot axis extends through both the upper and lower members 48, 49 of the hold down mechanism 148.

As shown in the drawings, each pivot member 53 preferably comprises a pivot pin which engages both the hold down mechanism and the first end portion 102 of a side wall 16. Even more preferably, a first pivot pin 53 extends between the upper member 48 of the hold down mechanism 148 and the upper surface 112 of a side wall 16, and second pivot pin extends between the lower member 49 of the hold down mechanism 148 and the lower surface 114 of a side wall 16. Preferably, each pivot pin 53 is secured to either the hold down mechanism 148 or the side wall 16, and is most preferably secured to the hold down mechanism 148.

Where the first and second pivot pins 53 are attached to the upper and lower members 48, 49 of the hold down mechanism 148, the upper and lower surfaces 112, 114 of each side wall are provided with cavities 54 which receive the pivot pins 53. Cavities 54 are located in the first end portion of each side wall 16 and are each shaped and sized to closely receive a pivot pin 53. This permits pivoting of the side wall 16 about pivot pin 53 but prevents transverse movement of the first end portion 102. In the most preferred embodiment of the invention, each cavity 54 is a cylindrical pivot hole.

Each hold down mechanism 148 is also provided with a movement limiting mechanism to limit the amount by which the second end portion 104 of each side wall can be transversely displaced by rotation of the side wall 16 about the pivot axis P. There are numerous types of movement limiting mechanisms which could be used in the present invention. Preferably, the movement limiting mechanism comprises a stop member which is received in a slot provided in either the hold down mechanism 148 or the side wall 16. The slot has sufficient length, measured in the transverse direction, such that movement of the pin between ends of the slot will allow the second end 104 of the side wall 16 to move into and out of engagement with one of the end surfaces of its associated end wall 17.

In the preferred embodiment, the stop member comprises one or more pins secured to the upper member 48 and/or the lower member 49 of the hold down mechanism 148, and a slot 55 is formed in one or both of the upper surface 112 and the lower surface 114 of the side wall. Preferably, the pin serving as the stop member is a pin 53 such as that which serves to retain the first end portions of the side walls 16. This provides the hold down mechanism 148 of the present invention with a simple, reversible construction.

As will be appreciated, the second end portion 104 of each side wall 16 rotates through an arc during pivoting of the side wall. The slots 55 formed in the upper and lower surfaces 112, 114 of side wall 16 are therefore preferably arc-shaped, with the arc having a radius equal to a distance between the pivot axis and the center of the slot 55.

Figure 7:
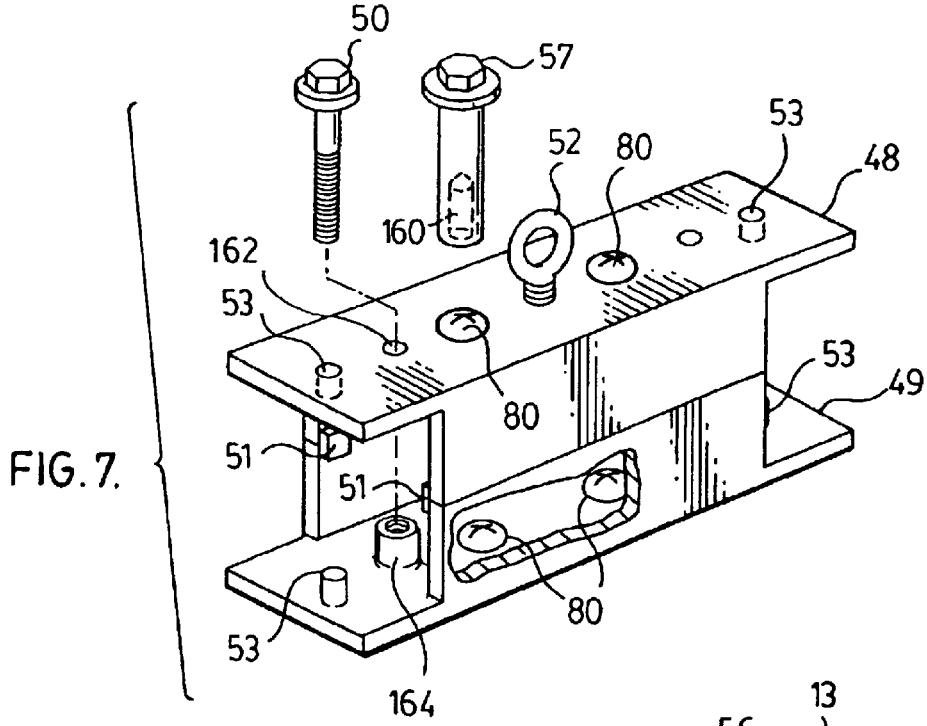
FIG. 7 is an enlarged perspective view of the hold down mechanism shown in FIG. 6.
Figure 8:
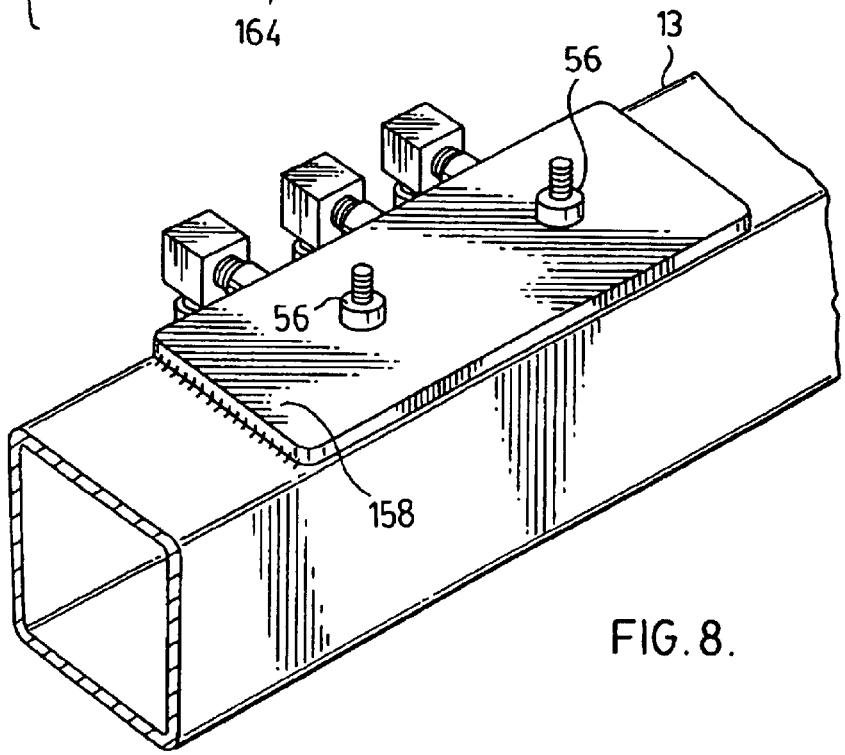
FIG. 8 is a perspective view of the centering mechanism for the mold assembly according to the invention mounted to a mold tube.

FIGS. 6 and 7 provide detailed views of the preferred structure of the hold down mechanism 148, with FIG. 6 showing a pair of hold down mechanisms 148 of different length for use in casting ingots of different thicknesses.

As shown in FIGS. 6 and 7, the upper member 48 of hold down mechanism 149 is generally U-shaped, having an upper plate 150 and a pair of sides 152. Similarly, the lower member 49 is U-shaped, comprising a lower plate 154 and a pair of sides 156. The upper plate 150 and lower plate 154 of upper and lower members 48, 49 carry the pivot/stop pins 53, and the sides 152 and 156 together form side walls of the hold down mechanism 148. The side walls have a height such that the upper and lower plates 150, 154 are separated by a distance which is slightly greater than a height of the mold side walls 16, to permit pivoting of the side walls 16.

Each hold down mechanism 148 is secured to a coolant tube 13 through a pair of upstanding centering protrusions 56 which are preferably formed on a plate 158 which is secured to the coolant tube 13 by welding or the like. The lower plate 154 of hold down mechanism 148 is provided with a pair of apertures which fit over the base portions of the centering protrusions 56. The upper plate 150 is provided with identical apertures 80 so that a stud 57 with an internally threaded bore can be inserted through the aperture 80 in the upper plate 150 and be threaded onto the threaded ends of centering protrusion 56. The upper and lower members 48, 49 of hold down mechanism 148 are secured together by bolts 50 which are threaded through an aperture 162 in the upper plate 150 and into a threaded hole 164 in the lower plate 154.

It will be appreciated that the distance between centering protrusions 56 on plate 158 is preferably constant, as is the distance between apertures 80 in the hold down mechanism 148, regardless of the dimensions of the hold down mechanism 148. Thus, hold down mechanisms 148 of different lengths can be retained on the same centering protrusions 56, enhancing the interchangeability of molds 15.

To prevent relative movement of the upper and lower members 48, 49 of hold down mechanism 148, a plurality of guides 51 are provided to lock and position the upper and lower members 48, 49. It will be appreciated that other types of locking arrangements could be used, for example pins, keys, key ways or any other means of positive engagement.

A lifting eye 52 is preferably provided centrally in the upper plate 150 in order to facilitate handling of the hold down mechanism 148, and also to facilitate handling of the entire adjustable mold assembly 15, thus permitting quick replacement or ingot thickness changes at the casting center.

As shown in FIG. 1, the mold assembly according to the invention further comprises a bottom block 60 which is received in the mold space 100 at the beginning of a casting operation and which is movable downwardly away from the mold during casting. Preferably, the bottom block 60 is adjustable in size for use in casting ingots of varying sizes. A preferred adjustable bottom block assembly 60 according to the invention is now described below with reference to FIGS. 11 to 13.

Figure 11:
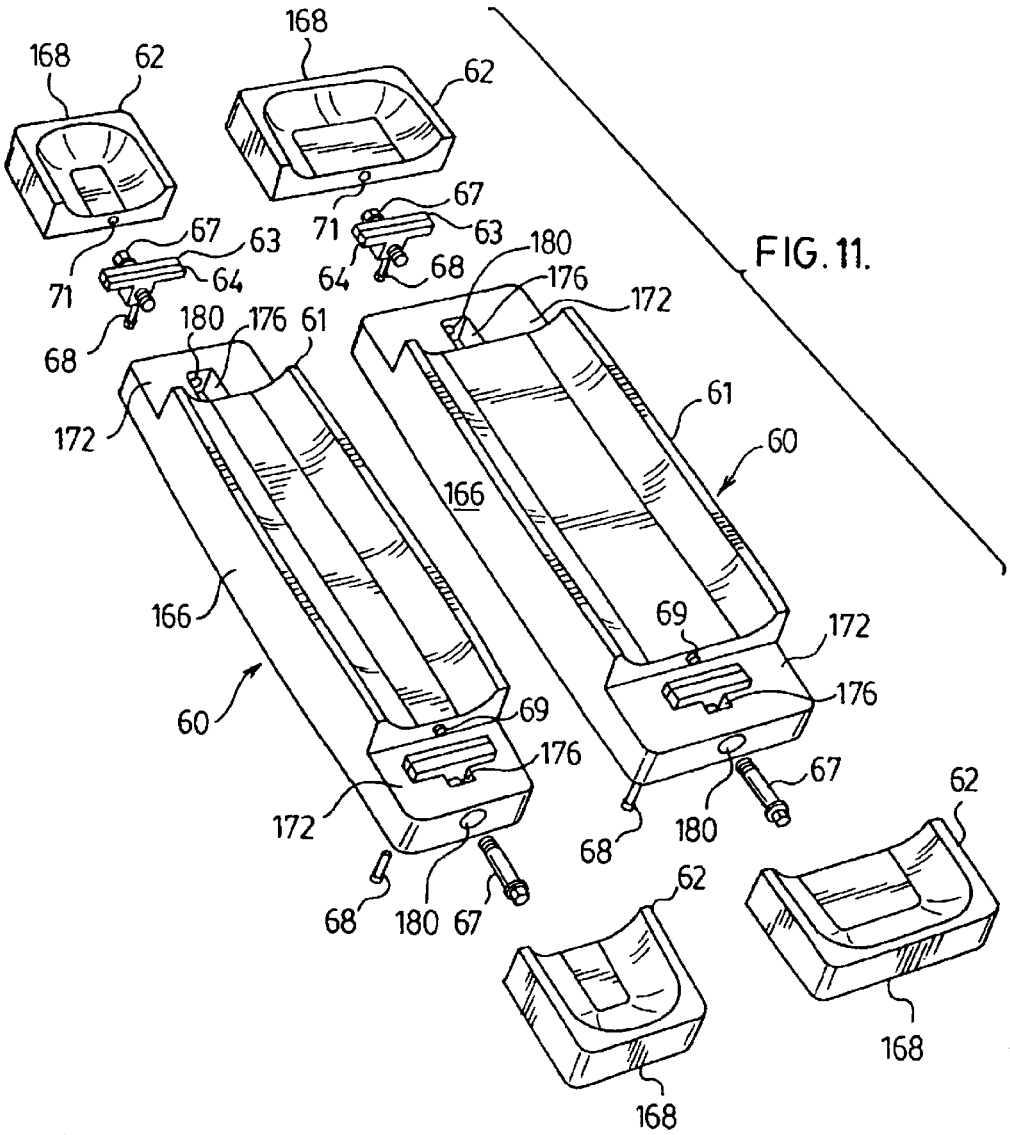
FIG. 11 is an exploded perspective view of two adjustable bottom block mechanisms of different cross-sectional areas according to the present invention.

FIG. 11 is an exploded view illustrating a pair of preferred bottom block assemblies 60 according to the present invention which are used for casting ingots of different sizes, the bottom block assembly 60 on the right side of FIG. 11 being used for casting thicker ingots than that shown on the left side of FIG. 11.

Figure 13:
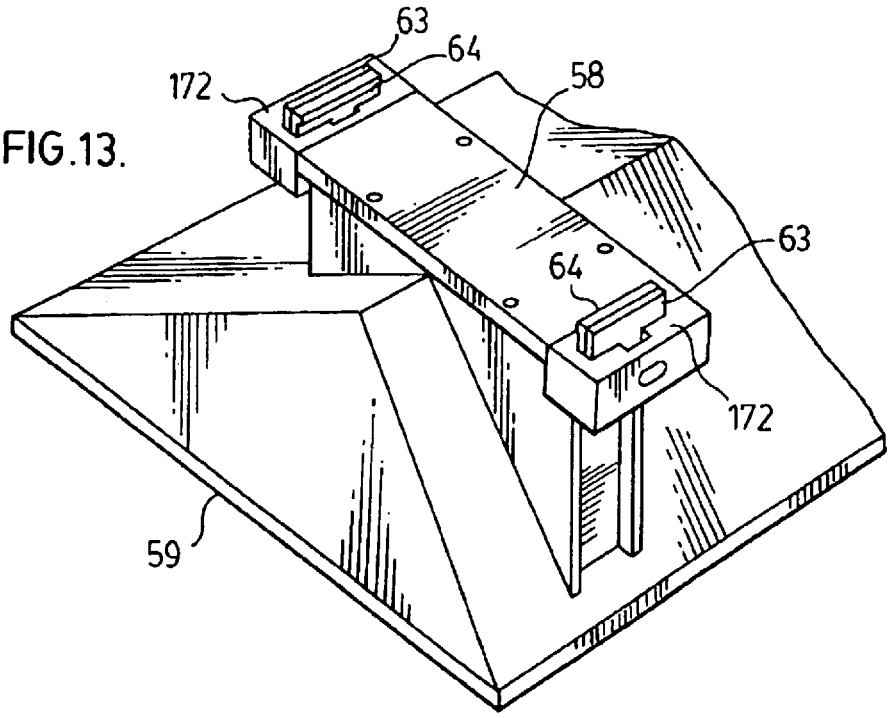
FIG. 13 is a perspective view of an adjustable bottom block clamping assembly according to the invention mounted in a mold table base plate.

The bottom block assembly 60 comprises a center section 61 which is attached to or integrally formed with a base plate 58 (FIG. 13). A plurality of bottom block mounting base plates 58 may preferably be provided on a mold table base plate 59, shown in FIG. 13.

The center section 61 of bottom block 60 has a pair of sides 166 which extend along the mold side walls 16 when the bottom block 60 is received in mold space 100. The bottom block 60 further comprises a pair of end sections 62, each having a side which extends along one of the mold end walls 17 when the bottom block assembly 60 is received in the mold space 100. At least one of the end sections 62 is releasably attached to the center section along a joint line 170 (FIG. 12) which extends between the sides 166 of the center section 61, the joint line 170 preferably extending parallel to the transverse axis. In the preferred embodiment shown in the drawings, both of the end sections 62 are releasably attached to the center section 61. In the bottom block 60 according to the present invention, each of the releasable end sections 62 is secured to the center section 61 by a clamping mechanism which preferably comprises a protrusion on either the center section 61 or the end section 62 which becomes received in a cavity formed in the other of the end section or the center section, with the protrusion being movable relative to the cavity thereby clamping the end section 62 into engagement with the center section 61 along the joint line 170.

In a preferred embodiment of the invention, a cavity 70 is formed in a lower surface of the releasable end section 62, and the protrusion comprises a movable clamping block 63 with a retractable jaw 64 which is provided on an upper surface of the center portion 61. Most preferably, the center section 61 is provided with a pair of extension portions 172 which extend longitudinally to either side of the joint line 170, such that each extension portion 172 underlies an end section 62 when the end section 62 is clamped into engagement with the center section 61.

As shown in FIG. 11, the clamping block 63 preferably extends transversely along an upper surface of the extension portion 172. The block 63 includes a lower portion 174 which extends into a rectangular recess 176 in the extension portion 172. The lower portion 174 of the clamping block 63 has a threaded bore which extends longitudinally when the lower portion 174 of block 63 is received in recess 176. Each end section 172 is also provided with a longitudinally extending aperture 180 which communicates with the interior of rectangular recess 176. A threaded fastener 67 extends through aperture 180 and is threaded through the bore 178 such that turning fastener 67 moves the block 63 toward and away from the joint line 170. The end of fastener 67 is secured by a bolt 68 extending at right angles through the bottom surface of extension portion 172, thereby preventing removal of bolt 67 from extension portion 172.

Figure 12:
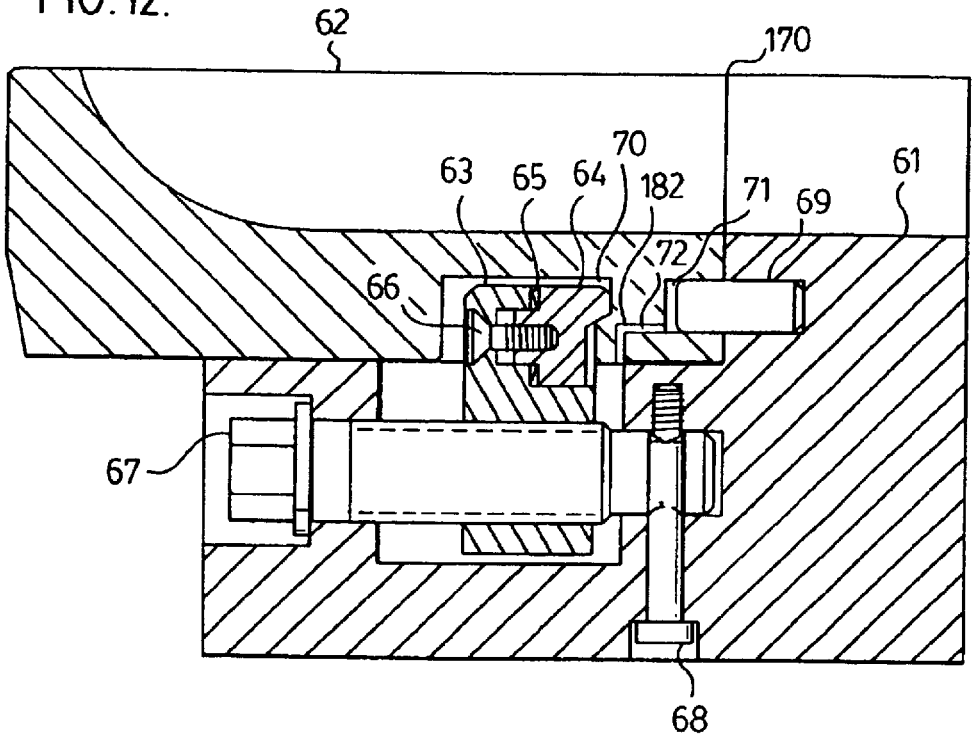
FIG. 12 is a longitudinal cross-section through one end of an assembled bottom block mechanism according to the invention.

As will be appreciated from FIG. 12, turning of bolt 67 will cause block 63 to move longitudinally through the recess 176, and advancing block 63 toward the joint line 170 will result in engagement of the jaw 64 with an inner surface 182 of the cavity 70, thereby clamping the releasable end section into engagement with the center section 61 along the joint line 170.

Preferably, the jaw 64 and the inner surface 182 of cavity 70 interlock with one another so as to prevent separation of the releasable end section 62 and the center section 61 when clamped together as shown in FIG. 12. In the preferred embodiment shown in FIG. 12, the jaw 64 is provided with a forwardly protruding surface and the inner surface 182 of cavity 70 is provided with a corresponding longitudinally extending recess. It will be seen that advancing the jaw toward the joint line 170 will cause jaw 64 to exert a force against the inner surface 182 of cavity 70, the force being directed toward the joint line 170.

Preferably, the jaw 64 is resiliently mounted on clamping block 63, with at least one fastener 66 securing the jaw 64 to the clamping block 63. One or more resilient members such as spring washers 65 are provided between the jaw 64 and the clamping block 63 so that the jaw 64 retracts as it is being forced against inner surface 182 of cavity 70. The jaw 64 moves longitudinally in response to differential expansion between center section 61 and end sections 62 which results from the combination of different materials which expand to different degrees with the thermal shock of contact with molten metal at the start of the cast. Thus, the retractable clamping mechanism remains securely clamped despite the effects of differential thermal expansion, while avoiding plastic deformation of end pieces 62, center section 61, as well as on clamping parts 63, 64, 67 and 68.

The bottom block assembly 60 is also preferably provided with one or more alignment members to ensure proper alignment of the releasable end portion 62 relative to the center portion 61 along the joint line 170. In the embodiment shown in the drawings, the alignment member comprises a longitudinally extending centering pin 69 engaging apertures in both the center section 61 and end section 62. The hole 71 formed in the end section 62 is preferably provided with a vent hole 72 through which fluids can be purged from the hole 71 during installation of end section 62.

Additional features of the preferred casting mold according to the invention are now described with reference to FIGS. 14 to 19. These features relate to prevention of excessive cooling at the corners of the ingot, by blocking some of the coolant openings in the side wall 16 and/or by blowing some of the coolant away from the surface of the ingot near its corners.

Figure 14:
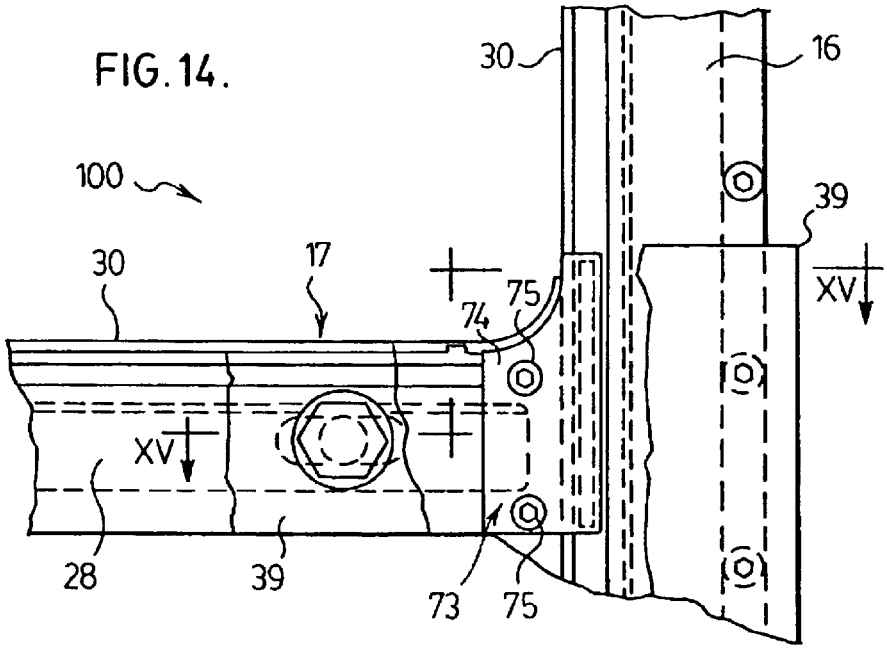
FIG. 14 is a partially cutaway bottom plan view of one corner of an adjustable mold assembly according to the invention illustrating a coolant corner plug.
Figure 15:
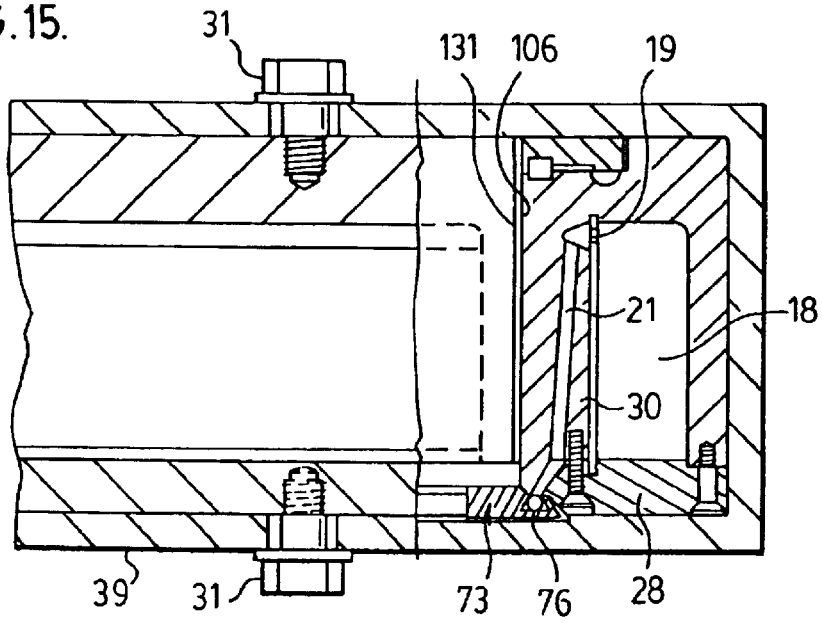
FIG. 15 is a transverse cross-section along the line XV—XV in FIG. 14.

A preferred means of blocking openings in side walls 16 is now described with reference to FIGS. 14 and 15, which illustrate a corner of the mold space 100 at which an end surface 131 of end wall 17 engages the inner surface 106 of a side wall 16. As shown in FIGS. 14 and 15, the lower surface of end wall 17 is provided with a corner plug assembly 73 comprising a corner plate 74 which is secured to the end wall 17 by threaded fasteners 75. It will be appreciated that the corner plate 74 could be integrally formed with the end wall 17.

As shown in FIG. 15, the corner plate protrudes outwardly past the end surfaces 131 of end wall 17, and preferably extends along the entire thickness of end wall 17 from its outer surface to the innermost extremity of its inner surface, generally following the shape of the end wall 17 at its ends. The portion of corner plate 74 which extends outwardly past the end walls 17 is provided with a groove in which is received a seal member 76, preferably an O-ring, Quad-ring or the like. The seal member 76 is positioned so that it engages the mouth of the coolant delivery chamber 29, thereby preventing the flow of coolant through the portion of the delivery chamber 29 which faces end surfaces 131 of end wall 17.

As shown in FIG. 14, the end wall 17 has a curved portion adjacent each of its end surfaces 131, such that the corners of mold space become rounded, and so that the end surfaces 131 of the end wall 17 have a greater area than a cross-sectional area of the end wall 17 midway between its end surfaces. In this way, the corner plug assembly 73 blocks at least a portion of the coolant delivery chamber 29 at the corners of mold space 100, thereby preventing excessive cooling at the corners of the ingot.

A preferred means for blowing coolant away from the corners of the mold is illustrated in FIGS. 16 to 19. In the embodiment shown in these drawings, a compressible or non-compressible fluid is directed at the coolant being sprayed at the surface of the ingot through coolant delivery chamber 29, blowing the coolant away from contact with the ingot corners.

Figure 16:
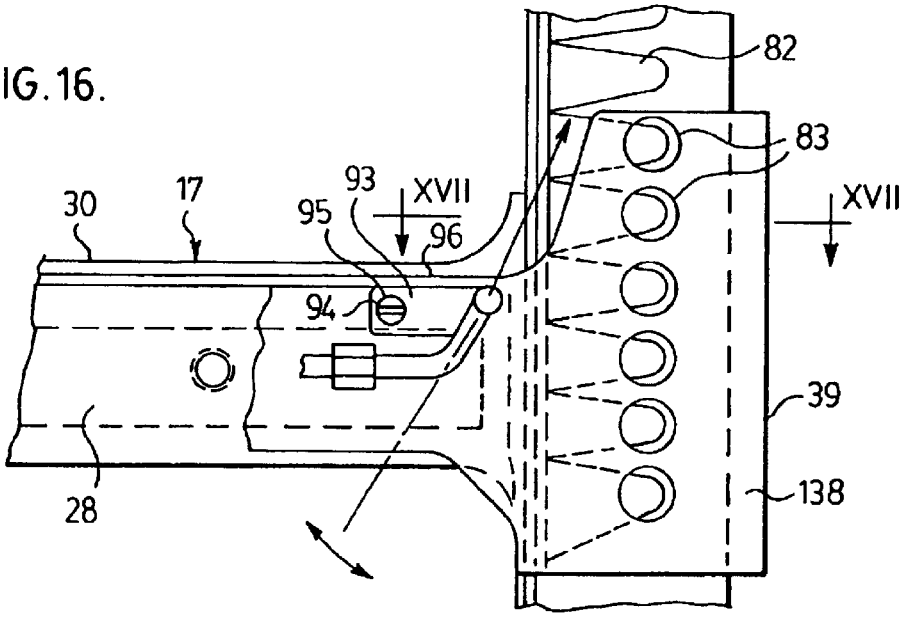
FIG. 16 is a partially cutaway bottom plan view of the corner of a mold assembly according to the invention illustrating a blower mechanism according to the invention.

Preferably, the fluid which is sprayed at the coolant is compressed air which is sprayed from a spray nozzle 90. As shown in FIG. 16, the spray nozzle 90 is preferably mounted on a retaining plate 93 which is secured to the lower transverse member 138 of sliding suspender 39 by a fastener 94. Preferably, the fastener 94 passes through a slot 95 in the retaining plate 93 to permit the direction of spray nozzle 90 to be adjusted relative to the corner of the mold. Preferably, a molten metal deflector plate 96 is provided along the inner edge of retaining plate 93, so as to prevent damage to the spraying nozzle 90 and air hoses by molten metal bleed-outs at or around the corners of the ingot at the bottom of the mold.

The air spray nozzle 90 is preferably a dual flat spray nozzle having an upper flat spray exit in the form of a slot 91 and a lower flat spray exit in the form of a slot 97. The nozzle 90 can be pivoted so that compressed air is directed at coolant exiting coolant chamber 29 adjacent the corners of mold 15, and so that the distance from which the exiting coolant can be blown away from the corners of the mold can be altered.

Figure 17:
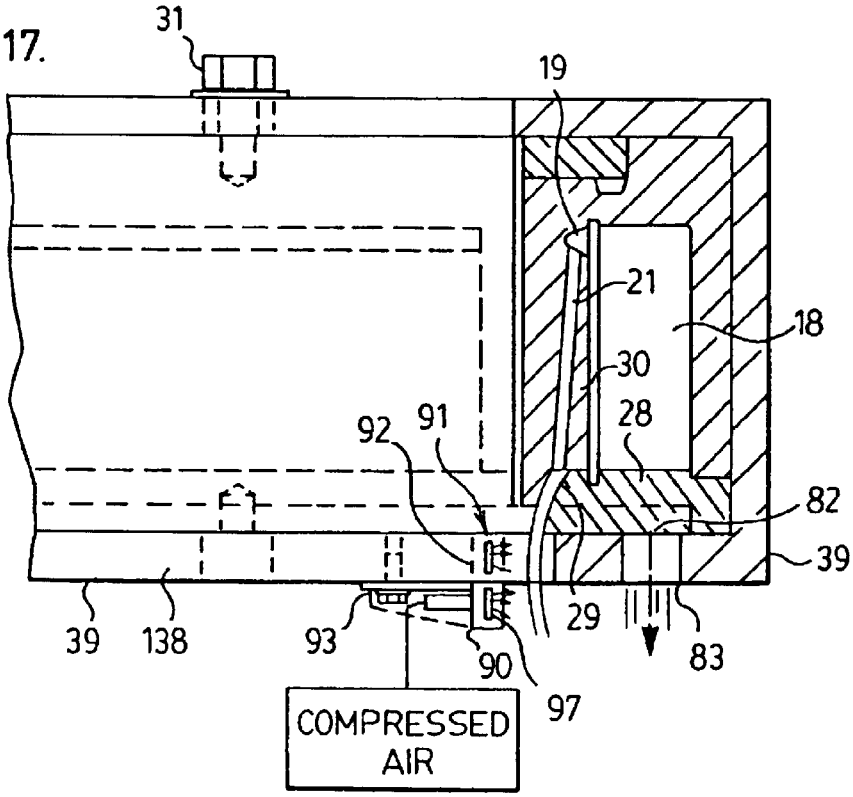
FIG. 17 is a cross-sectional view along line XVII—XVII of FIG. 16.
Figure 18:
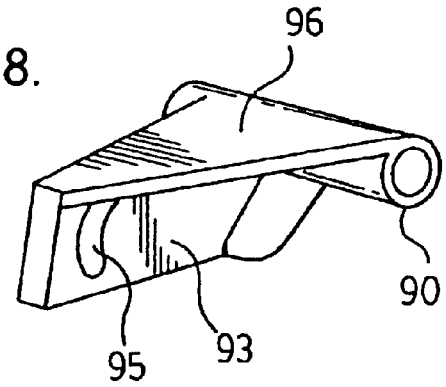
FIG. 18 is an isolated perspective view of the spray nozzle retainer plate shown in FIGS. 16 and 17.
Figure 19:
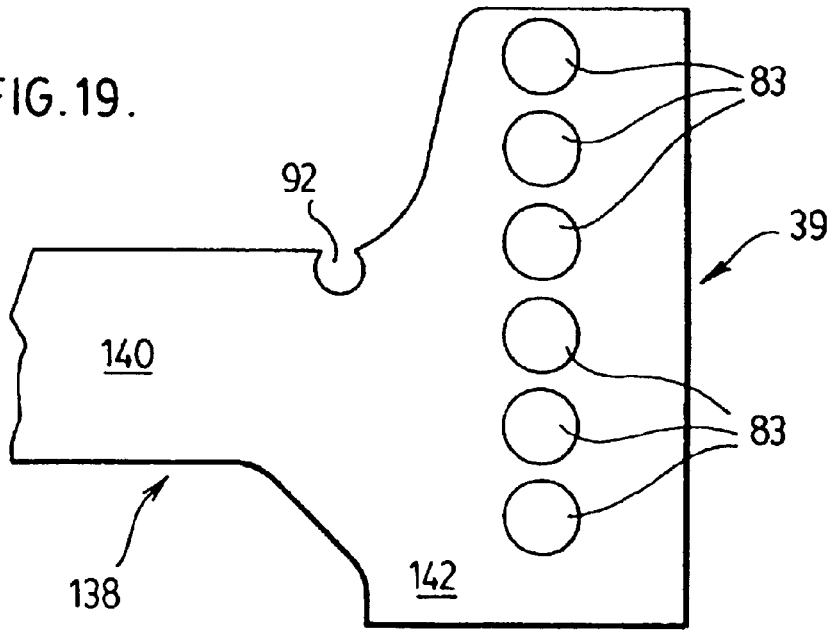
FIG. 19 is an isolated bottom plan view of a portion of the sliding suspender shown in FIG. 16.

The lower transverse member 138 of sliding suspender 39 is provided with a bore 92 adjacent the corner of mold 15. As shown in FIG. 17, the upper flat spray exit 91 of nozzle 90 is located inside bore 92, whereas the lower flat spray exit 97 is located below the lower surface of sliding suspender 39. As shown in FIG. 19, the bore 92 is open around a portion of its circumference so that fluid sprayed from the upper flat spray exit 91 may be directed toward the corners of the mold.

To assist in redirecting the coolant blown back by the compressed air from nozzle 90, the lower transverse member 138 of sliding suspender 39 is preferably also provided with a series of apertures 83 arranged in spaced relation to one another parallel to the longitudinal axis of mold 15. The spaced apertures 83 are in at least partial registration with drain grooves 82 formed in the lower surface of baffle plate 28 of side wall 16, these grooves 82 being in communication with the mouth of coolant delivery chamber 29. Accordingly, a portion of the coolant exiting chamber 29 is redirected by blower 90 through grooves 82 and exits the mold through apertures 83, away from the ingot surface.

Although the invention has been described in connection with certain preferred embodiments, it is not to be limited thereto. Rather, the invention is intended to include all embodiments which may fall within the scope of the following claims.

What is claimed is:

1. A mold for direct chill casting of metal ingots, the mold comprising a pair of opposed side walls and a pair of opposed end walls which together define a generally rectangular mold space having an open top through which molten metal enters the mold;

each of the side walls having a first end portion, an opposed second end portion, an inner surface and an opposed outer surface, and at least one of the end walls comprising a movable end wall assembly which is movable relative to the side walls to alter an area of the mold space, each of the movable end wall assemblies comprising:

(a) a central end wall member extending across a space between the end portions of the side walls, the central end wall member having opposed end surfaces which are sealable against the inner surfaces of the side walls;

(b) a pair of upper extension members attached to the central end wall member, each of the upper extension members extending outwardly beyond an end surface of the central end wall member and over one of the side walls;

(c) a pair of lower extension members attached to the central end wall member, each of the lower extension members extending outwardly beyond an end surface of the central end wall and under one of the side walls;

(d) a pair of connecting members, each of which extends along the outer surface of one of the side walls and connects one of the lower extension members and one of the upper extension members, wherein the extension members and the connecting members together define a pair of spaces, each located outwardly of an end surface of the central end wall member, through which the side walls extend; and (e) clamping means movable with the movable end wall assembly to clamp the side walls into sealing engagement with the end surfaces of the central end wall member.

2. The mold according to claim 1, wherein the upper extension members are formed at opposite ends of an upper retaining member which is secured to an upper surface of the central end wall member, and the lower extension members are formed at opposite ends of a lower retaining member which is secured to a lower surface of the central end wall member.

3. The mold according to claim 1, wherein the clamping means is provided on at least one of the connecting members, each clamping means exerting an inwardly directed clamping force on one of the side walls to clamp the central end wall member proximate its centre of gravity, and an outward force on the connecting member on which the clamping means is provided.

4. The mold according to claim 3, wherein the clamping means comprises a wedge clamp comprising a vertical wedge received between one of the connecting members and the outer surface of one of the side walls, the wedge having a relatively thick upper end and a relatively thin lower end, the wedge being driven downwardly to increase the clamping force exerted on the side wall.

5. The mold according to claim 4, wherein the wedge clamp further comprises a manually adjustable screw mechanism for adjusting the clamping force.

6. The mold according to claim 1, wherein the vertical wedge is received in a groove formed in an inner surface of the connecting member, the groove having a depth which is less than a thickness of the upper end of the vertical wedge.

7. The mold according to claim 3, wherein the connecting member on which the clamping means is provided is connected to the upper and lower extension members in an interlocking arrangement to prevent movement of the connecting member relative to the upper and lower extension members in response to the outward force exerted by the clamping means.

8. The mold according to claim 1, wherein the end portions of the opposed side walls are parallel to each other.

9. The mold according to claim 1, wherein both of the end walls are comprised of movable end wall assemblies.

10. The mold according to claim 1, wherein each of the side walls has an internal coolant passage and a plurality of coolant openings communicating with the internal coolant passage, the coolant openings being positioned proximate the inner surface of the side wall and oriented to receive coolant from the coolant passage and direct the coolant downwardly and inwardly at the ingot as it emerges from a lower end of the mold, and wherein each of the movable end wall assemblies is provided with sealing means to block the coolant openings proximate the end surfaces of the central end wall member.

11. The mold according to claim 10, wherein the sealing means comprises at least one resilient sealing member.

12. The mold according to claim 10, wherein the sealing means is provided on the movable end wall assembly outwardly of each end surface of the central end wall member.

13. The mold according to claim 10, wherein the central end wall member is curved at its opposite ends so as to form curved corners with the side walls, such the end surfaces of the central end wall member have a greater area than a cross-sectional area of the central end wall member through the end wall member midway between the end surfaces, and wherein the sealing means blocks at least some of the coolant openings which are directed at a corner of the ingot emerging from the lower end of the mold.

14. The mold according to claim 1, wherein each of the side walls has an internal coolant passage and a plurality of coolant openings communicating with the internal coolant passage, the coolant openings being positioned proximate the inner surface of the side wall and oriented to receive coolant from the coolant passage and direct the coolant downwardly and inwardly at the ingot as it emerges from a lower end of the mold, the mold further comprising:

(f) blower means for blowing a fluid toward the coolant as it exits one or more of the coolant openings in the side wall, the blower being directed to blow the coolant away from contact with corners of the ingot emerging from the lower end of the mold.

15. The mold according to claim 14, wherein each of the lower extension members comprises a bottom plate having a plurality of spaced apertures which are in at least partial registration with some of the coolant openings, and which are spaced away from the inner surface of the side wall relative to the coolant openings.

16. The mold according to claim 15, wherein the lower surface of the side wall is provided with a plurality of drain grooves through which the apertures in the bottom plate communicate with the coolant openings in the side wall, the grooves extending along an axis which is substantially perpendicular to the side walls.

17. The mold according to claim 15, wherein the blower means comprises a blower for blowing a compressible or non-compressible fluid.

18. The mold according to claim 15, wherein the blower means comprises a compressed air blower.

19. The mold according to claim 15, wherein the blower means is mounted to a lower surface of each lower extension member, proximate a corner of the mold space.

20. The mold according to claim 1, wherein each of the side walls is pivotable about a pivot axis extending through its first end portion, the pivot axis being perpendicular to a plane defined by the mold space, wherein pivoting of each side wall about the pivot axis displaces the second end portion of that side wall relative to the other side wall, thereby altering a distance across the mold space between the end portions of the opposed side walls.

21. The mold according to claim 20, wherein the first end portion of one side wall is directly across the mold space from the second end portion of the other side wall.

22. The mold according to claim 20 wherein at least one of the end walls is movable relative to the side walls to alter an area of the mold space, the at least one end wall being clamped between the first end portion of one side wall and the second end portion of the other side wall.

23. The mold according to claim 22, wherein both of the end walls are movable.

24. The mold according to claim 23, wherein the end portions of one side wall are parallel to the end portions of the other side wall when the end surfaces of the end walls are sealed to the inner surfaces of the side walls.

25. The mold according to claim 20, wherein each of the side walls has a generally rectangular transverse cross-section and has an upper surface and an opposed lower surface, with each end portion of each side wall being secured to a stationary surface by a hold down mechanism having an upper member and a lower member between which the end portion of the side wall is received.

26. The mold according to claim 25, wherein two hold down mechanisms are provided at opposite ends of the mold, each hold down mechanism retaining the first end portion of one of the side walls and the second end portion of the other side wall.

27. The mold according to claim 26, wherein the pivot axis about which each side wall pivots extends through the upper and lower members of the hold down mechanism which retains the side wall, and through the first end portion of the side wall.

28. The mold according to claim 27, wherein each side wall pivots about a pivot member coincident with the pivot axis.

29. The mold according to claim 28, wherein the pivot member comprises at least one pivot pin engages both the hold down mechanism and the first end portion of the side wall.

30. The mold according to claim 29, wherein the pivot member comprises a first pivot pin extending between the upper member of the hold down mechanism and the upper surface of the side wall and a second pivot pin extending between the lower member of the hold down mechanism and the lower surface of the side wall.

31. The mold according to claim 30, wherein the first and second pivot pins are attached to the upper and lower members of the hold down mechanism respectively, and wherein the upper and lower surface of each side wall is provided with cavities to closely receive the pivot pins.

32. The mold according to claim 25, wherein each hold down mechanism is provided with one or more movement limiting means to limit the amount by which the second end portion of each side wall can be displaced by rotation of the side wall about the pivot axis.

33. The mold according to claim 32, wherein each of the movement limiting means comprises pin extending between the hold down mechanism or the side wall and a slot in which the pin is received, the slot having sufficient length such that movement of the pin between the ends of the slot will allow the second end of the side wall to move into and out of engagement with one of the side surfaces of an end wall.

34. The mold according to claim 33, wherein the slot of each movement limiting means is formed in either the upper or lower surface of a side wall, and the pin is attached to either the upper or lower member of the hold down mechanism.

35. The mold according to claim 34, wherein the second end of each of the side walls is movable through an arc having a radius equal to a distance between the pivot axis and a center of the slot.

36. The mold according to claim 34, wherein the upper and lower members of each hold down mechanism respectively comprise an upper plate and a lower plate which are parallel to one another, and wherein the hold down mechanism further comprises a pair of side walls extending between the upper and lower plates, the side walls of the hold down mechanism having a height such that the upper and lower plates are separated by a distance which is slightly greater than a height of the mold side walls.

37. The mold according to claim 36, wherein the hold down mechanism comprises a pair of U-shaped members fastened together, each U-shaped member having a bight portion and a pair of legs, the bight portion of one U-shaped member comprising the upper plate of the hold down mechanism and the bight portion of the other U-shaped member comprising the lower plate of the hold down mechanism, the legs of the U-shaped members forming the side walls of the hold down mechanism.

38. The mold according to claim 1, further comprising a bottom block which is received in the mold space at the beginning of a casting operation and which is movable downwardly away from the mold during casting, the bottom block comprising:

(a) a center section attached to a base plate, the center section having opposed sides which extend along the mold side walls when the bottom block is received in the mold space; and (b) a pair of end sections, each having a side which extends along one of the mold end walls when the bottom block is received in the mold space, wherein at least one of the end sections is releasably attached to the center section along a joint line which extends between the sides of the center section;

each of the at least one releasable end sections being secured to the center section by a clamping mechanism comprising:

(i) a cavity provided in a surface of one of the end section and the center section;

(ii) a protrusion provided on a surface of the other of the end section and the center section, the protrusion being received in the cavity when the end section is attached to the center section along the joint line, and (iii) moving means for moving the protrusion relative to the cavity;

wherein the cavity has an inner surface, the moving means moving the protrusion into engagement with the inner surface of the cavity to clamp the end section into engagement with the center section along the joint line.

39. The mold according to claim 38, wherein the cavity of the clamping mechanism is provided in a lower surface of the releasable end section, and the protrusion is provided on an upper surface of an extension portion which is attached to the center portion and underlies the end section when the end section is clamped into engagement with the center section along the joint line.

40. The mold according to claim 38, wherein the protrusion and the inner surface of the cavity are engaged when the releasable end section is clamped into engagement with the center section along the joint line.

41. The mold according to claim 40, wherein the protrusion and the inner surface of the cavity interlock so as to prevent separation of the releasable end section and the center section when the protrusion and the inner surface of the cavity are engaged.

42. The mold according to claim 38, wherein the moving means moves the protrusion toward and away from the joint line between the releasable end section and the center section, such that a force exerted by the protrusion against the inner surface of the cavity is directed toward the joint line between the releasable end section and the center section.

43. The mold according to claim 38, wherein the moving means comprises a screw threadingly engaged to a threaded bore in the protrusion.

44. The mold according to claim 39, wherein the moving means comprises a screw threadingly engaged to a threaded bore in the protrusion, the screw extending toward the joint line through the extension portion of the center portion and into the bore of the protrusion, the extension portion being provided with screw retaining means to prevent withdrawal of the screw from the extension portion.

45. The mold according to claim 38, wherein at least one alignment member is provided along the joint line to align the releasable end portion relative to the center portion.

46. The mold according to claim 45, wherein the at least one alignment member comprises at least one alignment pin extending substantially perpendicular to the joint line.

47. The mold according to claim 38, wherein the protrusion comprises a spring-loaded portion having an engagement surface which engages the inner surface of the cavity, the spring loaded portion being movable relative to a remainder of the protrusion during engagement of the protrusion with the inner surface of the cavity.

48. The mold according to claim 38, wherein the center section is attached to the base plate through a bottom block mounting plate.

* * * * *